US009247781B2

(12) United States Patent
Nishiwaki et al.

(10) Patent No.: US 9,247,781 B2
(45) **Date of Patent: *Feb. 2, 2016**

(54) SHOE HAVING LACE FITTING STRUCTURE

(75) Inventors: Tsuyoshi Nishiwaki, Kobe (JP); Kenta Moriyasu, Kobe (JP); Seigo Nakaya, Kobe (JP); Moe Nagata, London (GB); Tomoko Ikezawa, Kobe (JP)

(73) Assignee: Asics Corporation, Chuo-ku, Kobe (JP)

( * ) Notice: Subject to any disclaimer, the term of this patent is extended or adjusted under 35 U.S.C. 154(b) by 762 days.

This patent is subject to a terminal disclaimer.

(21) Appl. No.: 13/380,805

(22) PCT Filed: Jan. 29, 2010

(86) PCT No.: PCT/JP2010/051275

§ 371 (c)(1),
(2), (4) Date: Feb. 14, 2012

(87) PCT Pub. No.: WO2011/004618

PCT Pub. Date: Jan. 13, 2011

(65) Prior Publication Data

US 2012/0131818 A1 May 31, 2012

(30) Foreign Application Priority Data

Jul. 6, 2009 (WO) ..... PCT/JP2009/003130

(51) Int. Cl.
*A43C 1/00* (2006.01)
*A43B 7/14* (2006.01)
(Continued)

(52) U.S. Cl.
CPC ..... *A43B 7/1495* (2013.01); *A43B 23/027* (2013.01); *A43B 23/0295* (2013.01); *A43C 1/00* (2013.01); *A43C 1/003* (2013.01); *A43C 11/008* (2013.01)

(58) Field of Classification Search
CPC ..... A43C 1/00; A43C 11/22; A43C 7/1495; A43C 1/003
USPC ..... 36/50.1, 51, 88, 50.5, 91
See application file for complete search history.

(56) References Cited

U.S. PATENT DOCUMENTS 4,811,500 A * 3/1989 Maccano ..... 36/91
5,167,084 A * 12/1992 Flammier ..... 36/117.2
(Continued)

FOREIGN PATENT DOCUMENTS

EP 0329392 A2 8/1989
JP 33-3132 3/1958
(Continued)

OTHER PUBLICATIONS

ASICS Catalogue Titled "1999 Athletic Shoes Sporting Equipment" Issued in Dec. 1998.
(Continued)

*Primary Examiner* — Jila M Mohandesi
(74) *Attorney, Agent, or Firm* — Mintz Levin Cohn Ferris Glovsky and Popeo, P.C.

(57) ABSTRACT

A shoe including a sole 1 for absorbing an impact of landing, an upper 2 for wrapping around an instep, and shoelace means 3 for fitting the upper 2 to the instep, the upper 2 including: a main portion 2M covering a medial side surface, a lateral side surface, a toe, the instep and a back surface of a foot; a side edge portion having a plurality of first eyelets H1; a first side panel 51 covering the medial side surface of the foot; and a second side panel 52 covering the lateral side surface of the foot, wherein each side panel includes: a tip portion 53 having a second eyelet H2 which is provided at a tip of the side panel and which the shoelace means passes through and engages with; a bottom portion 54 attached to the main portion and/or the sole; and a middle portion 55 arranged between the tip portion and the bottom portion so as to allow the tip portion to move in the front-back direction of the foot with respect to the bottom portion, wherein with at least one of the side panels, the middle portion 55 can stretch and shrink to increase a length from the tip portion to the bottom portion.

2 Claims, 26 Drawing Sheets

(51) Int. Cl.

| | |
|---|---|
| ***A43B 23/02*** | (2006.01) |
| *A43C 11/00* | (2006.01) |

(56) References Cited

U.S. PATENT DOCUMENTS

| | | | | |
|---|---|---|---|---|
| 5,692,320 | A * | 12/1997 | Nichols | 36/51 |
| 5,940,990 | A * | 8/1999 | Barret | 36/55 |
| 5,966,841 | A * | 10/1999 | Barret | 36/50.1 |
| D453,413 | S | 2/2002 | Tsujino et al. | |
| 6,367,169 | B1 * | 4/2002 | Barret | 36/51 |
| 6,601,323 | B2 | 8/2003 | Tsujino et al. | |
| D518,283 | S | 4/2006 | Kayano et al. | |
| D527,174 | S | 8/2006 | Kayano et al. | |
| D527,516 | S | 9/2006 | Kayano et al. | |
| D528,761 | S | 9/2006 | Kayano et al. | |
| D552,833 | S | 10/2007 | Yamashita et al. | |
| D561,442 | S | 2/2008 | Kayano et al. | |
| D582,658 | S | 12/2008 | Fujita et al. | |
| 7,613,588 | B2 | 11/2009 | Katsu et al. | |
| D614,855 | S | 5/2010 | Inohara et al. | |
| D659,371 | S | 5/2012 | Yano et al. | |
| 8,272,148 | B2 | 9/2012 | Nishiwaki et al. | |
| 8,375,602 | B2 * | 2/2013 | Takada et al. | 36/50.1 |
| 2006/0162190 | A1 | 7/2006 | Nishiwaki et al. | |
| 2010/0205832 | A1 | 8/2010 | Takada et al. | |
| 2012/0124866 | A1 | 5/2012 | Moriyasu et al. | |
| 2012/0131818 | A1 | 5/2012 | Nishiwaki et al. | |
| 2013/0008053 | A1 | 1/2013 | Nishiwaki et al. | |

FOREIGN PATENT DOCUMENTS

| | | | |
|---|---|---|---|
| JP | 33-5240 | | 4/1958 |
| JP | 3-55710 | U | 5/1991 |
| JP | 04-044701 | A | 2/1992 |
| JP | 5-9843 | | 3/1993 |
| JP | 3026562 | U | 7/1996 |
| JP | 11-018803 | A | 1/1999 |
| JP | 2001046103 | A | 2/2001 |
| JP | 2005013365 | A | 1/2005 |
| JP | 2006-000258 | A | 1/2006 |
| JP | 2007-190351 | A | 8/2007 |
| WO | WO-2004093587 | A1 | 11/2004 |
| WO | WO-2009050819 | A1 | 4/2009 |

OTHER PUBLICATIONS

International Search Report issued in International Application No. PCT/JP2012/056878, mailed Jun. 12, 2012.

* cited by examiner

Test Example1

Test Example2

Test Example3

Test Example4

Reference exampple

Test Example11

Test Example12

Test Example13

Test Example14

Test Example15

Test Example16

Test Example17

Test Example11

Test Example12

Test Example17

Test Example16

SHOE HAVING LACE FITTING STRUCTURE

TECHNICAL FIELD

The present invention relates to a shoe having a lace fitting structure.

BACKGROUND ART

A shoelace fits an upper to the foot. The upper fitting the foot supports the foot.

However, during dorsal flexion of the MP joint, the foot shape changes, and therefore the foot circumference also changes. When shoes are worn over a long period of time, the foot circumference increases in many cases. In such a case, the foot inside a shoe will be compressed by the upper. Moreover, the shoe and the foot are likely to slip against each other during action.

[First Patent Document] Japanese Laid-Open Patent Publication No. 2006-258 (abstract)

[Second Patent Document] Japanese Laid-Open Patent Publication No. 11-18803 (abstract)

[Third Patent Document] Japanese Utility Model Publication for Opposition No. 33-5240 (FIG. 1)

[Fourth Patent Document] Japanese Utility Model Publication for Opposition No. 5-9843 (FIG. 3)

[Fifth Patent Document] EPO 329,392 A2 (abstract)

[Sixth Patent Document] Japanese Laid-Open Patent Publication No. 4-44701 (page 2, upper right col.)

[Seventh Patent Document] WO 2004/93587 A1, US 2006/0162190 A1 (abstract)

With a shoe of the first document, non-stretchable belts are fixed to the inner side of a stretchable upper, and the non-stretchable belts prevent the upper from stretching. In the shoe of the first document, an eyelet (loop) is provided at the tip of each non-stretchable belt, and therefore the eyelet will not move in the foot circumference direction in the shoe (while the shoe is worn).

The belts are continuous with each other in the front-back direction, with the tips of the belts attached to the stretchable member of the upper, and therefore the belts are prevented from being displaced freely.

A shoe of the second document has a size that is variable in the foot length direction. In order for the size to be variable in the foot length direction, this shoe includes, provided in the middle foot portion, a flexible fabric portion that is stretchable in the front-back direction of the upper. The flexible fabric portion does not stretch in the circumference direction. Therefore, since the eyelets provided in the flexible fabric portion do not move in the circumference direction, the foot will be compressed while the shoe is worn.

A shoe of the third document includes a wide stretchable piece on each side surface of the front foot portion. The wide stretchable piece may feel less compressive to the foot. However, the wide stretchable piece will not be able to support the side surface of the foot.

Since the ornamental eyelets are continuous with each other in the front-back direction, the eyelets will not move in the front-back direction. Therefore, the eyelets are prevented from moving freely.

The eyelet members of the fourth document are formed by a resin whose Shore hardness is 90 to 100. A resin whose Shore hardness is 90 to 100 will hardly stretch.

With a shoe of the fifth document, the rear foot portion is supported by a non-stretching supporting stirrup.

A shoe of the sixth document includes a pair of side panels (fastening bands) sandwiched between the inner skin and the outer skin of the upper. The side panels may be formed by a rubber sheet or a stretchable fabric, and each includes three eyelets. The aim of the shoe of the sixth document is that the side panel stretches and shrinks in the circumference direction depending on the magnitude of the foot circumference (circumferential length) of the person.

However, with the invention of the sixth document, the object is that the side panels connected together with shoelaces do not move on the upper skin in the front-back direction and reliably fasten a predetermined position of the instep of the foot, as stated on (page 1, right col. or) page 2, lower right col. of the publication, and the side panels are wide. Therefore, eyelets formed in the side panels are not at all intended to move in the front-back direction of the foot, and it is believed that they do not substantially move so.

With the invention of the sixth document, the side panels formed by a rubber sheet or a stretchable fabric cover large areas of the side surfaces of the foot, and even cover areas posterior to the metatarsal bones. This will detract from the upper's function of holding or supporting the foot of the wearer.

With a shoe of the seventh document, eyelets formed by loops are provided in the vicinity of stretchable portions. Although it may appear from FIG. 5 of the seventh document that the loops are connected to the stretchable portions, the loops are provided on hard portions of the upper as can be seen from FIGS. 3 to 6 of the publication.

Therefore, the eyelets formed by loops shown in the publication cannot move in the circumference direction.

SUMMARY OF THE INVENTION

Technical Problem

It is an object of the present invention to provide a shoe capable of supporting the foot in a stable state, and decreasing the compression on the foot when the foot circumference changes and/or the slip between the shoe and the foot while in action.

Solution to Problem

A shoe of an embodiment of the present invention is a shoe having a lace fitting structure, including: a sole for absorbing an impact of landing, an upper for wrapping around an instep, and a shoelace means for fitting the upper to the instep, wherein the upper includes a first opening from which a leg extends upward when the shoe is worn, and a second opening provided on a front side of the first opening, the two openings being continuous with each other in a front-back direction, the upper including: a main portion covering a medial side surface, a lateral side surface, a toe, the instep and a back surface of a foot; and a first side edge portion and a second side edge portion provided along a side edge of the second opening and having a plurality of first eyelets and one or more second eyelets, respectively, which the shoelace means passes through and engages with, wherein: the second side edge portion is connected to the main portion via a stretchable portion, wherein the stretchable portion is more stretchable than the side edge portions and the main portion so that the second side edge portion move with respect to the main portion in a circumference direction, a front direction and a rear direction of the foot when the foot is bent, the stretchable portion is stretchable in the circumference direction of the foot in the vicinity of the second side edge portion at least in the circumference direction when the foot is bent, and the stretchable portion is arranged in such a state that the stretchable portion is stretchable in the front-back direction on a front side and a rear side of the second side edge portion; and the main portion which is less stretchable than the stretchable portion covers a Lisfranc joint and a metatarsal bone base of a fifth toe on a lateral side of the foot, and the main portion covers a base and/or a head of a metatarsal bone of a first toe on a medial side of the foot.

Advantageous Effects of the Invention

With this embodiment, the stretchable portion stretches and shrinks in the circumference direction of the foot in response to a change in the foot circumference following foot flexion or long hours of use. Therefore, the upper more easily fits to the foot.

The second eyelet being movable also in the front-back direction of the foot will further improve the fitness property of the upper.

That is, the second eyelet moves both in the circumference direction and the front-back direction of the foot.

In the present invention, in order to realize advantages that the upper fits to the foot, it is necessary that the second side edge portion be connected to the main portion essentially only via the stretchable portion. For example, if the stretchable portion is compared to the sea and the main portion to the land, the second side edge portion is arranged in an island pattern off the main portion which is the land. While a plurality of eyelets may be formed in one second side edge portion which is less stretchable, it is necessary that the second side edge portion be arranged in an island pattern off the main portion also in such a case.

In the present invention, the advantages will be sufficiently realized if the stretchable portion is not plastically deformed (but is elastically deformed) when the stretch of the stretchable portion is in the range of at least 2.0 mm or less, preferably in the range of 3.0 mm or less, after the second eyelet is pulled in the circumference direction.

In the present invention, the advantages will be sufficiently realized if the stretchable portion undergoes essentially no plastic deformation when the second eyelet is displaced (moved) in the front-back direction so that the amount of movement is in the range of 0.5 mm or less, preferably in the range of 1.0 mm or less.

This is because the second eyelet does not move in two directions (the circumference direction and the front-back direction) when the foot circumference changes unless a certain degree of stretch or displacement is gained in the elastic range.

The essentially non-stretching main portion covers the Lisfranc joint and the metatarsal bone base of the fifth toe on the lateral side of the foot, and the main portion covers the base and/or the head of the metatarsal bone of the first toe on the medial side of the foot. This stabilizes the foot support.

The meaning of the term "a shoelace means" as used in the present invention is not limited to cases where there is only a single shoelace, but includes cases where there are two or more shoelaces.

The term "eyelet" as used in the present invention means the hole itself which the shoelace passes through.

Therefore, an "eyelet" as used in the present invention includes a through hole formed by an eyelet member of a loop material, and also includes an eyelet that is formed by an eyelet member of a U-shaped metal part or a resin.

In the present invention, the stretchable portion capable of easily stretching and shrinking may be a sheet-like or band-like member with rubber elasticity whose material has a small Young's modulus, as well as a material that essentially is not stretchable but includes a plurality of circular, rectangular or square through holes arranged in a staggered pattern so as to reproduce stretchability. The stretchable portion may be formed by laying two stretchable fabric-like members on top of each other.

In the present invention, the main portion which is less stretchable than the stretchable portion may be obtained by restricting a stretchable mesh material with a non-stretchable tape material so that it becomes essentially non-stretching.

MODE FOR CARRYING OUT THE INVENTION

Figure 1:
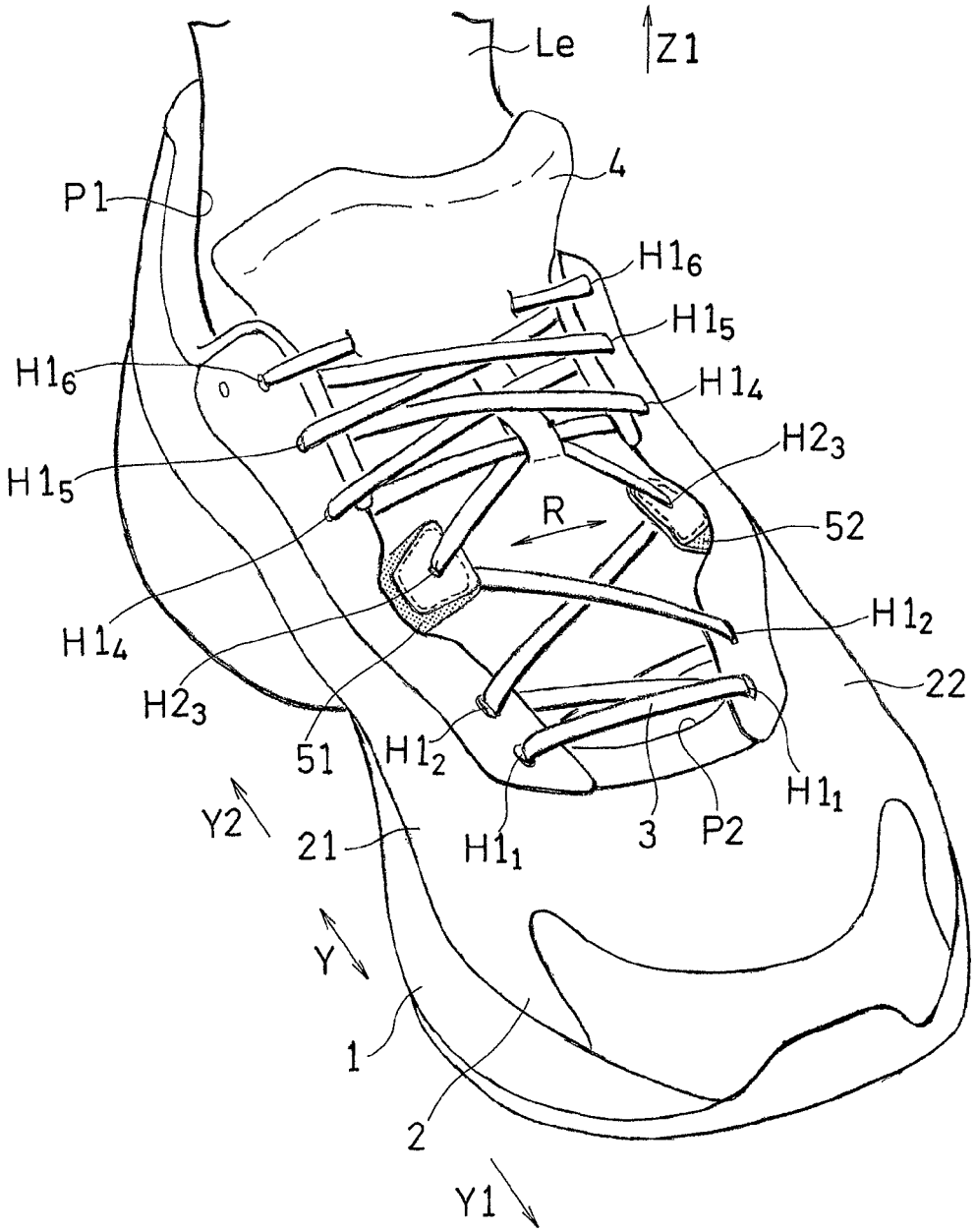
FIG. 1 is a schematic perspective view showing a shoe according to a first embodiment of the present invention.

In a preferred embodiment of the present embodiment, the second eyelet is arranged only in the area from the metatarsal phalangeal joint (so-called the "MP joint") of the first toe to the Lisfranc joint of the fourth toe in the front-back direction of the foot.

In this case, the area has a significant influence on the fitness property of the upper. Thus, the fitness property of the upper will increase if the second eyelet is arranged in such an area.

In this case, the second eyelet is not arranged in an area anterior to the MP joint of the first toe or an area posterior to the Lisfranc joint of the fourth toe. Therefore, the foot support by the upper will not become unstable.

In another preferred embodiment, the second eyelet is provided on each of the medial side and the lateral side of the foot.

Where a pair of second eyelets are provided, the positions of the pair of second eyelets can change individually. Therefore, the fitness property of the upper will be further enhanced.

In a more preferred embodiment, the second eyelet on the medial side of the foot is arranged only at a position posterior to the metatarsal phalangeal joint of the first toe and anterior to the base of the metatarsal bone of the first toe; and the second eyelet on the lateral side is arranged only at a position posterior to a metatarsal phalangeal joint of the fourth toe and anterior to a base of a metatarsal bone of the fourth toe.

In this embodiment, if the second eyelets are arranged at such positions, the pair of second eyelets move in the circumference direction of the foot in response to a change in the foot circumference.

This movement will prevent an increase in the change of the tensile force on the shoelace means engaged with the second eyelet. Thus, the upper will have a high fitness property.

If second eyelets are not arranged at positions other than those described above, the foot support will unlikely become unstable.

In a preferred embodiment of the present embodiment, one or two, but not three or more, second eyelets are provided on the medial side of the foot; and one or two, but not three or more, second eyelets are provided on the lateral side of the foot.

If three or more second eyelets are provided on the medial side or the lateral side of the foot, the foot support may become unstable and the cost may increase. Therefore, it is preferred that there are two or less second eyelets on each of the medial and lateral sides of the foot.

The second eyelet loosens the fastening of the upper by the shoelace.

Therefore, it will be preferred that the number of second eyelets is smaller than the number of first eyelets.

Moreover, it is presumed that it is more preferred that the number of second eyelets is only one on each of the medial side and the lateral side of the foot.

In view of the above, it will be preferred that the first eyelets are arranged so as to oppose each other in each of the first half and the second half of the second opening in the front-back direction.

The first eyelets stabilize the foot support. Therefore, a plurality of second eyelets may be provided on the medial side or the lateral side, and the first eyelet may be provided between the plurality of second eyelets on the medial side or the lateral side.

In another preferred embodiment of the present embodiment, the stretchable portion surrounds the second side edge portion from a front side, a rear side and a lower side of the second side edge portion, the stretchable portion including: a first portion arranged along a side edge of the second opening on the front side and the rear side of the second side edge portion; and a second portion arranged on the lower side of the second side edge portion, the first portion being less stretchable than the second portion.

In this embodiment, with the first portion which is less stretchable than the second portion, it is possible to control the maximum amount by which the second side edge portion moves in the front-back direction or prevent inadvertent movement of the second side edge portion in the front-back direction when tying the shoelace. Thus, the second portion of the stretchable portion can be given a small rigidity such that it stretches easily.

In a more preferred embodiment, the second opening is curved in an area of the first portion, and the first portion is curved along the second opening; and the curved first portion stretches in the front-back direction as the curved first portion is deformed into a straight shape, and shrinks in the front-back direction with an increase in a curvature of the curved first portion.

Thus, the first portion which is less stretchable can be produced easily and at low cost.

In another preferred embodiment of the present embodiment, the stretchable portion covers a portion of the medial side surface or the lateral side surface of the foot, and does not extend across the main portion of the upper on the medial side surface and the lateral side surface; and under the stretchable portion, a portion of the main portion anterior to the stretchable portion and another portion of the main portion posterior to the stretchable portion are connected with each other via a member which is less stretchable than the stretchable portion.

In this case, since the stretchable portion does not extend across the side surface of the upper, it is possible to prevent the foot support from becoming unstable due to the stretchable portion, regardless of the area of the upper in which the stretchable portion is provided.

In this case, another stretchable portion extending across the main portion of the upper may be provided, as necessary, so as to make the upper fit to the foot.

Moreover, the other stretchable portion may be provided on the medial side of the foot, and another second side edge portion which has another second eyelet may be provided in the other stretchable portion.

A shoe of another embodiment of the present invention is a shoe having a lace fitting structure, including: a sole for absorbing an impact of landing, an upper for wrapping around an instep, and a shoelace means for fitting the upper to the instep, wherein the upper includes a first opening from which a leg extends upward when the shoe is worn, and a second opening provided on a front side of the first opening, the two openings being continuous with each other in a front-back direction, the upper including: a main portion covering a medial side surface, a lateral side surface, a toe, the instep, and a back surface of a foot; a side edge portion provided along a side edge of the second opening and having a plurality of first eyelets which the shoelace means passes through and engages with; a first side panel covering the medial side surface of the foot and extending in an upward direction or a diagonally upward direction along the medial side surface in a space inside or outside the main portion; and a second side panel covering the lateral side surface of the foot and extending in the upward direction or the diagonally upward direction along the lateral side surface in the space inside or outside the main portion, wherein each of the side panels includes: a tip portion having a second eyelet which is provided at a tip of each of the side panels and which the shoelace means passes through and engages with; a bottom portion attached to the main portion and/or the sole; and a middle portion arranged between the tip portion and the bottom portion so as to allow the tip portion to move in the front-back direction of the foot with respect to the bottom portion, wherein with at least one of the side panels, the middle portion can stretch and shrink to increase a length from the tip portion to the bottom portion.

In the present embodiment, the middle portion of the side panel stretches and shrinks in response to a change in the foot circumference. The middle portion of this side panel can be provided in a long pattern along the medial and lateral side surfaces of the foot, and therefore the amount by which the middle portion stretches and shrinks is large even if the middle portion is formed by a rigid member. Therefore, the upper has a high fitness property.

As the tip portion of the side panel pivots about the bottom portion as the center, the second eyelet can also move in the front-back direction of the foot. Therefore, the fitness property of the upper will be further enhanced.

That is, the second eyelet moves both in the circumference direction and the front-back direction of the foot.

The stretchable portion which stretches easily is provided in a side panel separate from the main portion. This stabilizes the foot support by the main portion which does not easily stretch.

In this embodiment, the side panel is provided in a space inside or outside the main portion.

In the present invention, the space inside the main portion means a space defined by the main portion, referring to a space inside of the exterior material of the main portion, and includes the space between the interior material and the exterior material in a case where the interior material exists. Therefore, where the main portion includes the exterior material and the interior material, each panel may be arranged between the interior material and the exterior material. That is, the present invention encompasses cases where each panel contacts the side surface or the instep of the foot via the interior material therebetween. The panel may be formed by the interior material.

In the present invention, if the side panel is provided in the space outside the main portion, the side panel wraps around the side surface of the foot via the main portion. Also in this case, the fitness property improves as the stretchable portion of the side panel stretches and shrinks.

However, it is preferred that the side panel is provided so that the side panel is in contact with the side surface of the foot. In this case, the side panel stretches immediately in response to a change in the foot circumference.

In this embodiment, it is preferred that the second eyelets are arranged only in an area from the MP joint of the first toe to the Lisfranc joint of the fourth toe in the front-back direction of the foot.

According to the present embodiment, the area has a significant influence on the fitness property of the upper. Thus, the fitness property of the upper will increase if the second eyelet is arranged in such an area.

In another preferred embodiment, the middle portion can stretch and shrink to increase the length from the tip portion to the bottom portion on both side panels.

According to the present embodiment, where a pair of stretchable middle portions is provided, the length of the pair of middle portions can significantly change in response to a change in the foot circumference. Therefore, the fitness property of the upper will be further enhanced.

In a more preferred embodiment, the second eyelet on the medial side of the foot is arranged only at a position posterior to the metatarsal phalangeal joint of the first toe and anterior to a base of a metatarsal bone of the first toe; and the second eyelet on the lateral side is arranged only at a position posterior to a metatarsal phalangeal joint of the fourth toe and anterior to a base of a metatarsal bone of the fourth toe.

According to the present embodiment, if the second eyelets are arranged at such positions, the pair of middle portions stretch and shrink in the circumference direction of the foot in response to a change in the foot circumference. This stretching/shrinking will prevent the change in the tension of the shoelace means engaged with the second eyelet from increasing. Therefore, the upper will have a high fitness property.

If second eyelets are not arranged at positions other than those described above, the foot support will unlikely become unstable.

In a preferred embodiment of the present embodiment, one or two, but not three or more, second eyelets are provided on the medial side of the foot; and one or two, but not three or more, second eyelets are provided on the lateral side of the foot.

If three or more second eyelets are provided on the medial side or the lateral side of the foot, the foot support may become unstable and the cost may increase. Therefore, it is preferred that there are two or less second eyelets on each of the medial and lateral sides of the foot.

The second eyelet loosens the fastening of the upper by the shoelace.

Therefore, it will be preferred that the number of second eyelets is smaller than the number of first eyelets.

Moreover, it is presumed that it is more preferred that the number of second eyelets is only one on each of the medial side and the lateral side of the foot.

In view of the above, it will be preferred that the first eyelets are arranged so as to oppose each other in each of the first half and the second half of the second opening.

A plurality of second eyelets may be provided on the medial side or the lateral side, and the first eyelet may be provided between the plurality of second eyelets on the medial side or the lateral side.

EMBODIMENTS

The present invention will be understood more clearly from the following description of preferred embodiments taken in conjunction with the accompanying drawings. Note however that the embodiments and the drawings are merely illustrative, and the scope of the present invention shall be defined by the appended claims. In the accompanying drawings, like reference numerals denote like components throughout the plurality of figures.

First Embodiment

A first embodiment of the present invention will now be described with reference to FIGS. 1 to 9.

A shoe for the left foot will be illustrated in the following description. In the following figures, the arrow OUT represents the lateral side direction of the shoe, and the arrow IN represents the medial side direction of the shoe.

General Structure of Shoe:

A shoe having a lace fitting structure shown in FIG. 1 includes a sole 1, an upper 2, and a shoelace 3.

The sole 1 is for absorbing an impact of landing. The upper 2 is for wrapping around the instep, and includes a tongue 4 (a portion of the main portion). The shoelace 3 is for fitting an upper 2 to the instep.

Figure 2:
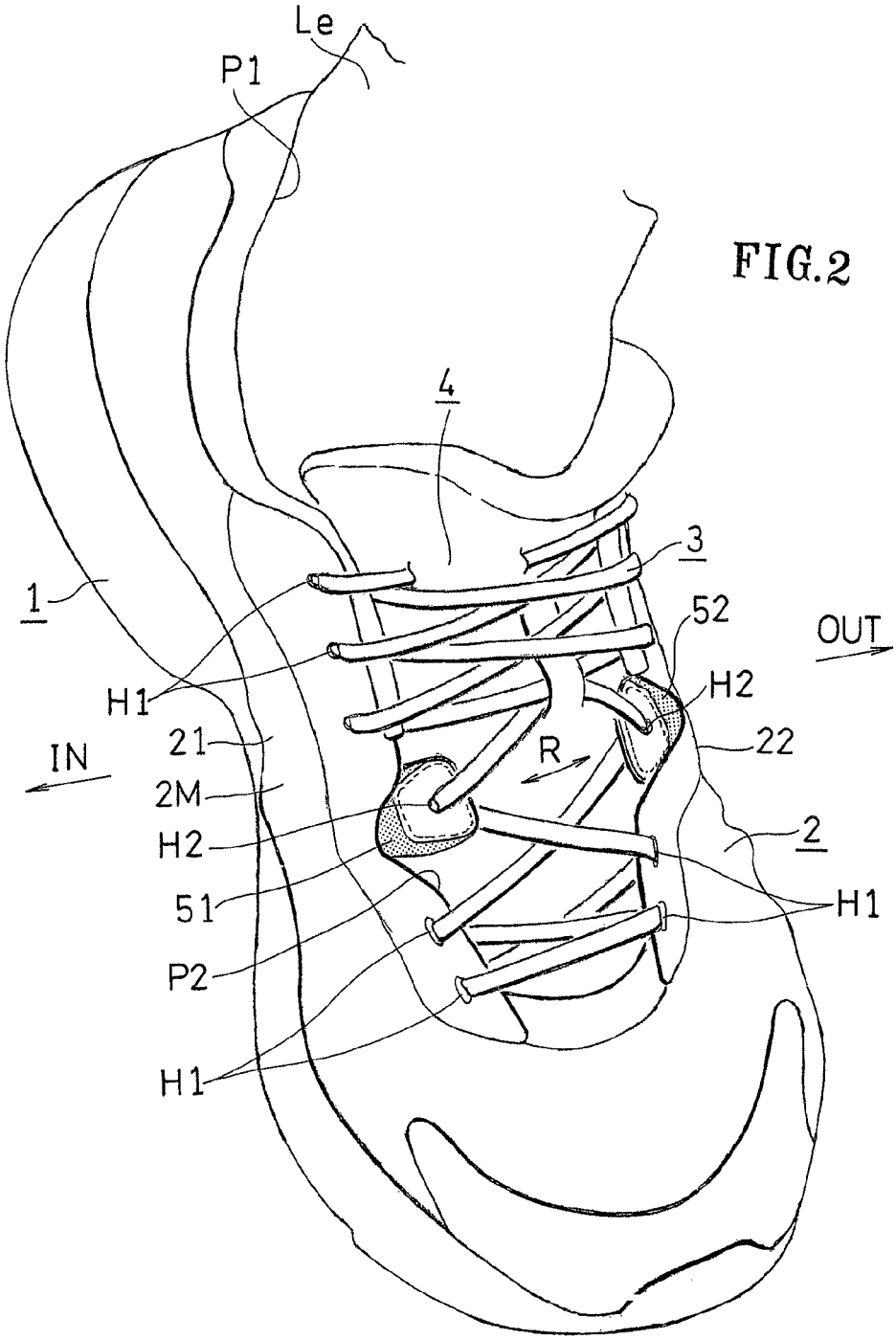
FIG. 2 is a schematic perspective view showing the shoe of the embodiment in a dorsally-flexed state achieved by wearing the shoe and raising the heel.

Although the end portions of the shoelace 3 are not shown in FIGS. 1 and 2, the end portions are firmly tied together after the foot is inserted into the upper 2. With the end portions of the shoelace 3 tied together, the upper 2 tightly fits to the foot.

Note that the end portions of the shoelace 3 may be firmly engaged with a fixture provided on the upper 2.

The upper 2 has a first opening P1 and a second opening P2. The first opening P1 is an opening from which a leg Le extends in the upward direction Z1 when the shoe is worn.

Figure 3:
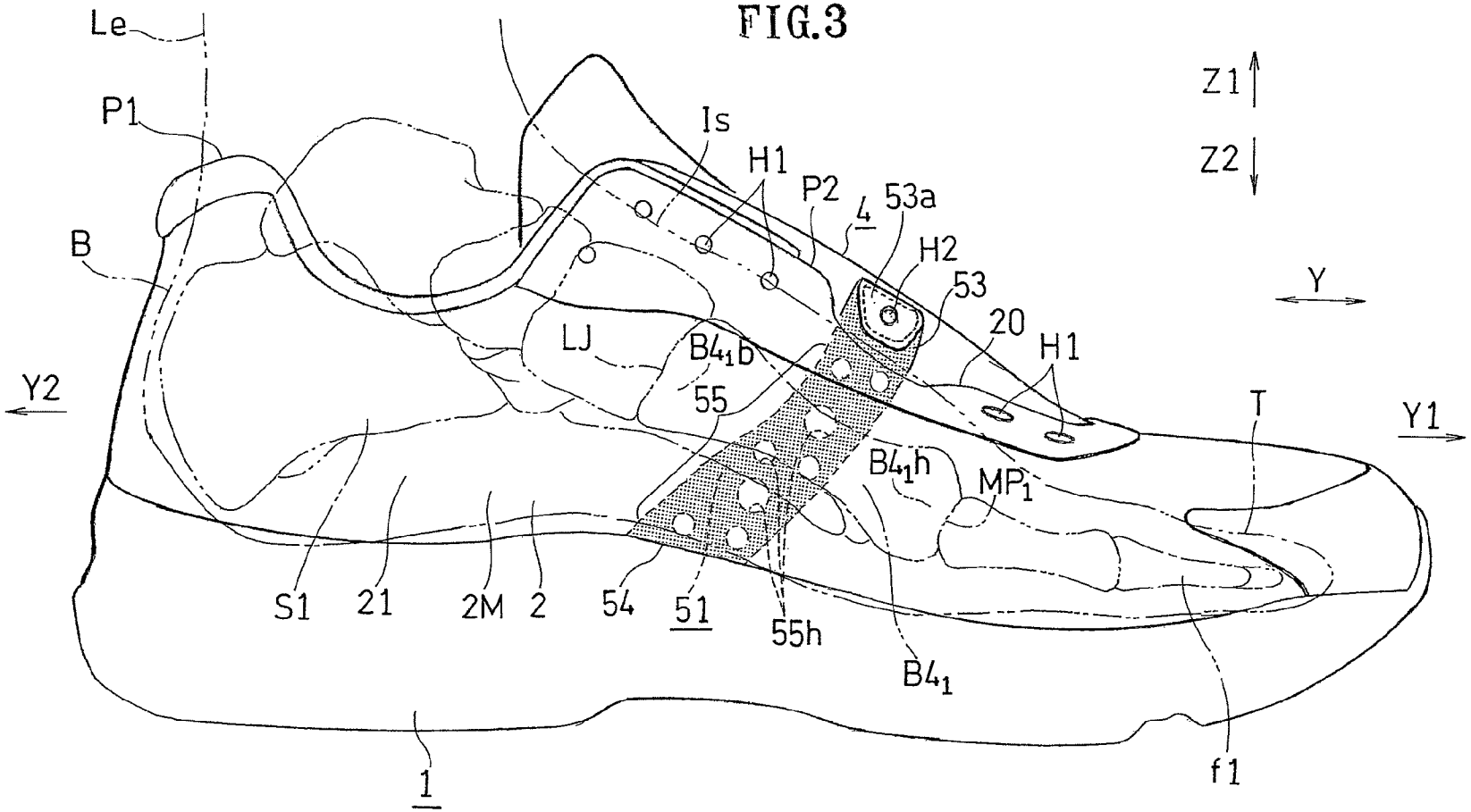
FIG. 3 is a schematic side view showing the relationship between the shoe of the embodiment and the foot bone structure as viewed from the medial side of the foot.
Figure 4:
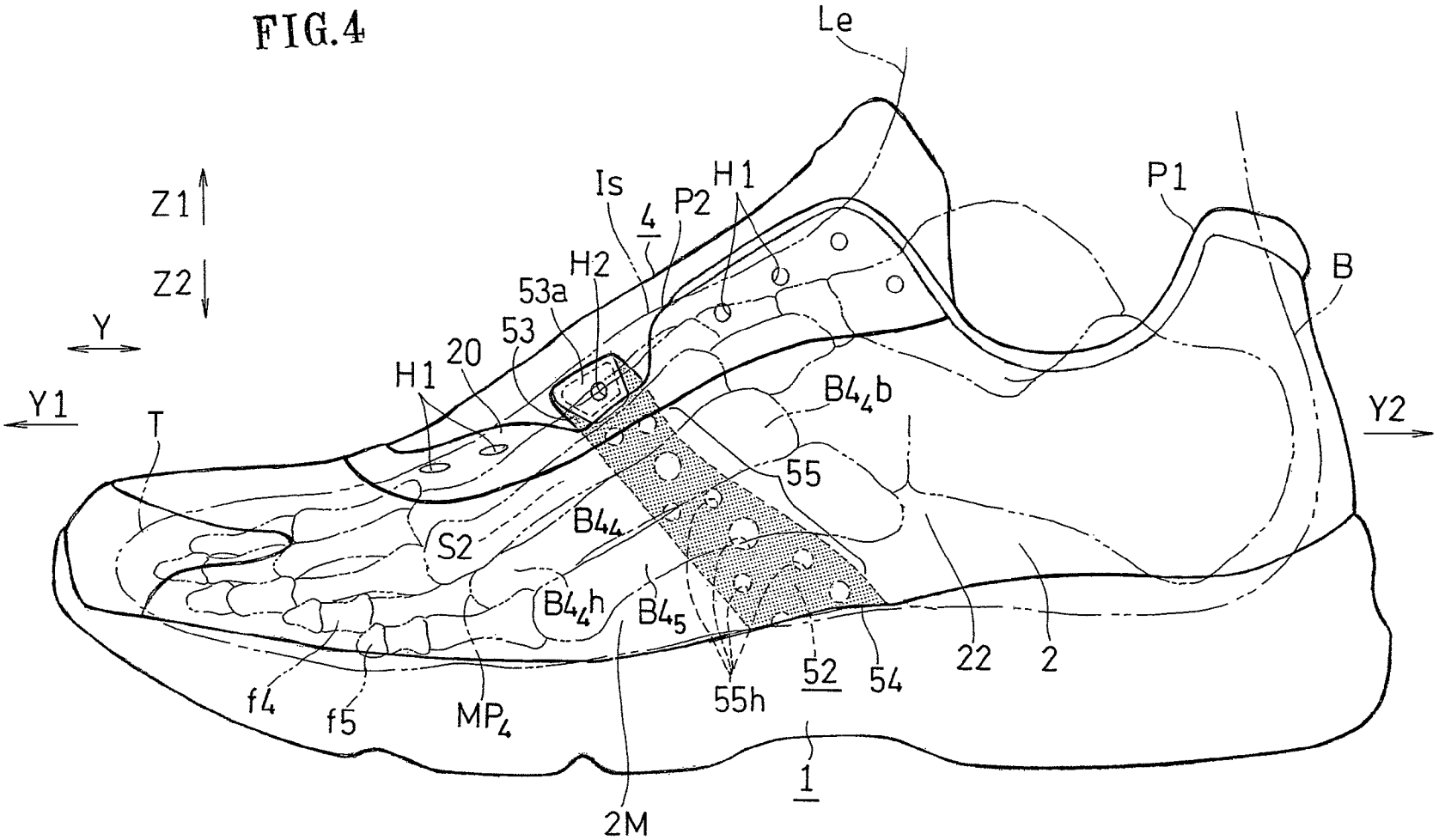
FIG. 4 is a schematic side view showing the relationship between the shoe of the embodiment and the foot bone structure as viewed from the lateral side of the foot.

As shown in FIGS. 3 and 4, the second opening P2 is an opening provided on the front side Y1 of the first opening P1, i.e., toward the toe T of the foot. In an upper portion of the upper 2, the second opening P2 is provided to be elongated in the front-back direction Y. The two openings P1 and P2 are continuous with each other. The tongue 4 closes the second opening P2 from the downward direction Z2, and wraps around the instep Is from above.

Figure 5:
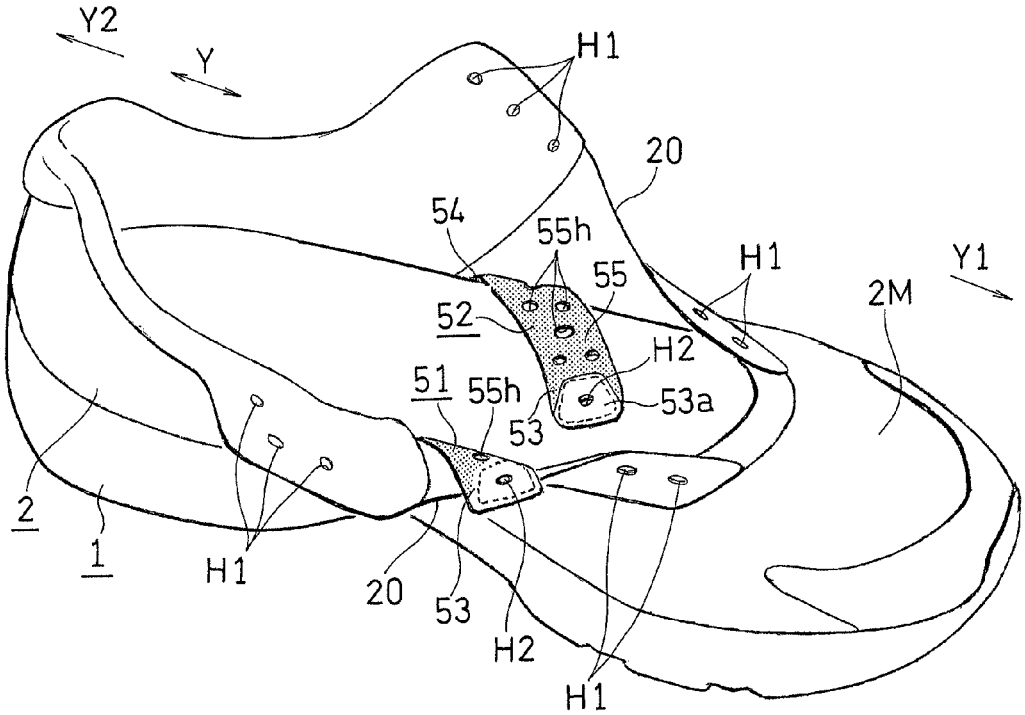
FIG. 5 is a schematic perspective view showing the inside of the shoe of the embodiment as viewed from the medial side of the foot.
Figure 6:
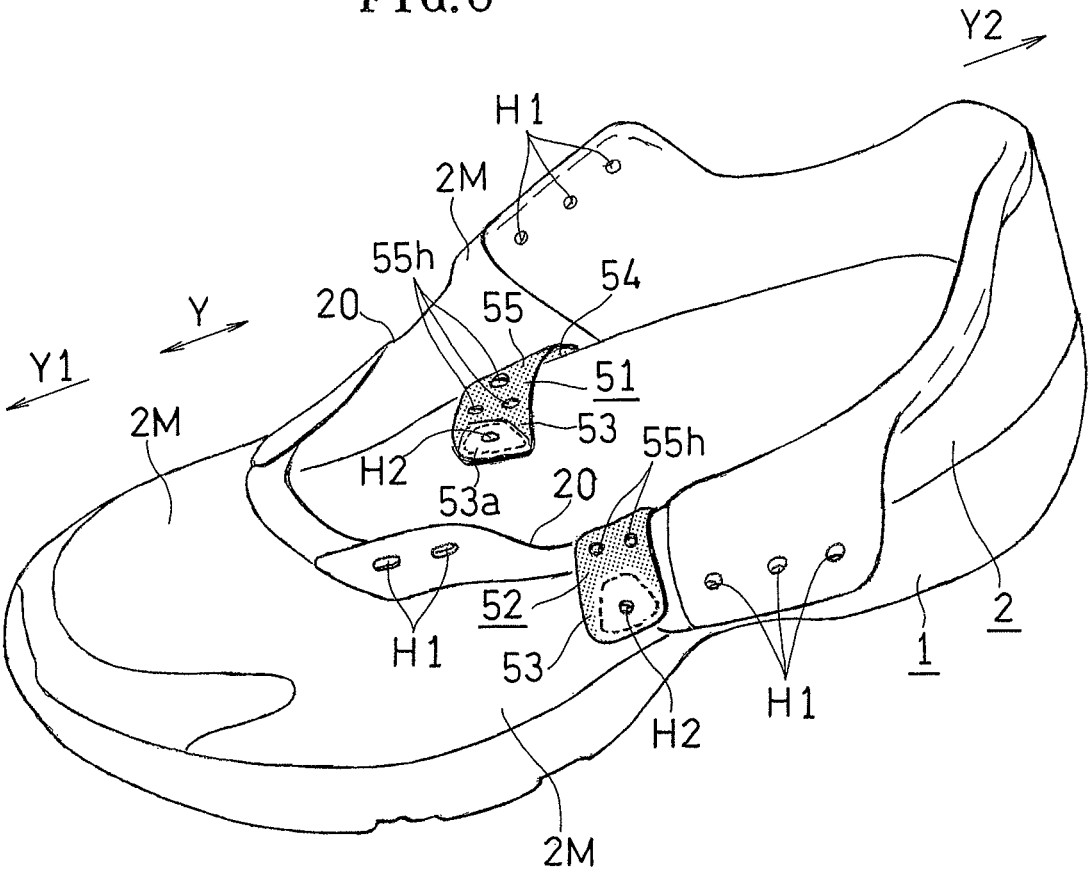
FIG. 6 is a schematic perspective view showing the inside of the shoe of the embodiment as viewed from the lateral side of the foot.

Upper 2:

In FIGS. 5 and 6, the upper 2 includes a main upper (main portion) 2M, a side edge portion 20, and first and second side panels 51 and 52.

Main Upper 2M:

The main upper 2M includes the medial side surface S1 of the foot of FIG. 3, the lateral side surface S2 of FIG. 4, the toe T, the instep Is, and the back surface B. The first opening P1 and the second opening P2 are formed in the main upper 2M, and the main upper 2M includes the tongue 4 which is continuous at the front edge of the second opening P2.

The side edge portion 20 is provided so as to surround the second opening P2 along the side edge of the second opening P2. The side edge portion 20 includes a plurality of first eyelets H1 which the shoelace 3 passes through and engages with. The side edge portion 20 is formed by an essentially non-stretching material such as an artificial leather or a tape material, for example. The first eyelets H1 are small holes formed in the side edge portion 20.

Figure 7:
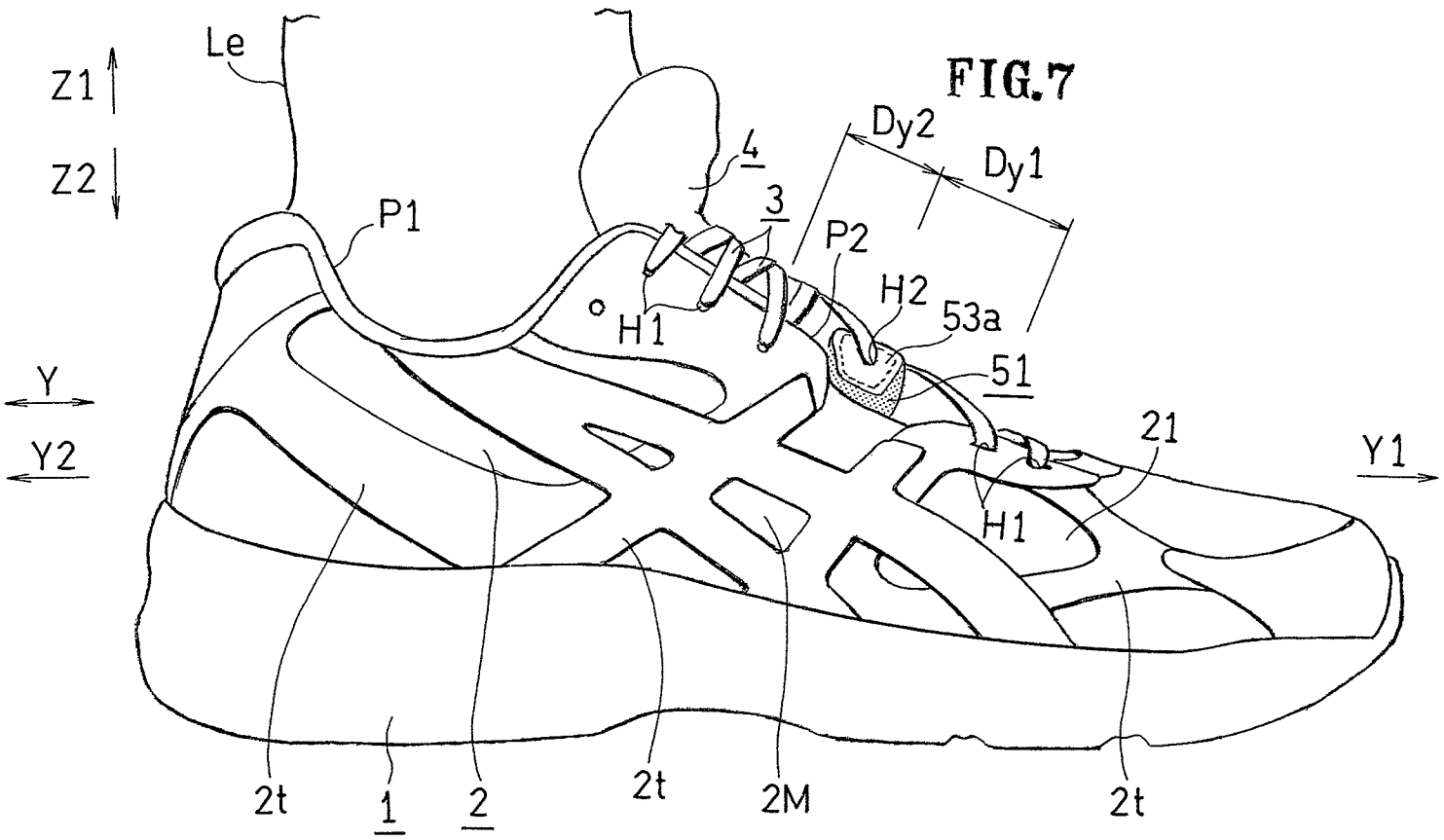
FIG. 7 is a schematic side view showing the shoe of the embodiment as viewed from the medial side of the foot.
Figure 8:
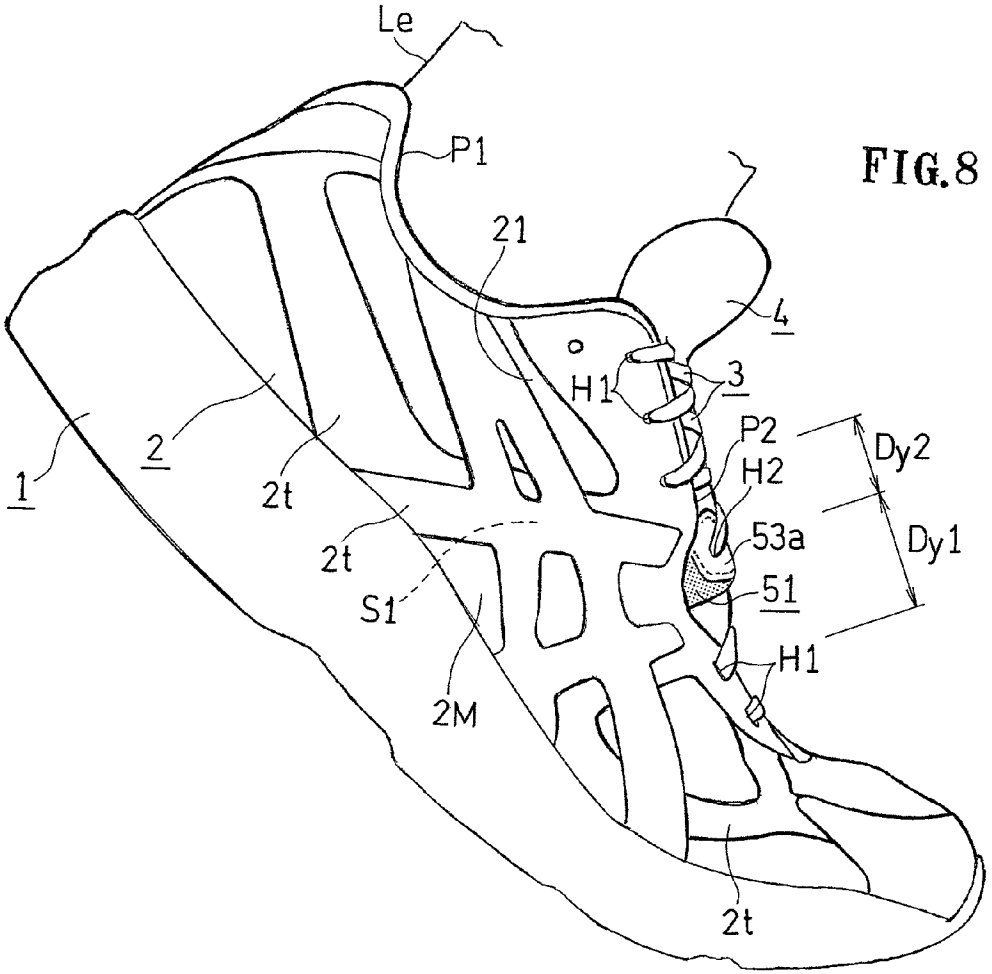
FIG. 8 is a schematic side view showing the shoe of the embodiment in a dorsally-flexed state achieved by wearing the shoe and raising the heel.

On the medial and lateral side surfaces 21 and 22 of the main upper 2M, a large number of tape materials 2*t* are sewn, for reinforcement, to the surface of the mesh member which forms a part of the main upper 2M, as clearly shown in the medial side views of FIGS. 7 and 8, for example. These tape materials 2*t* are formed by an essentially non-stretching material, and therefore the medial side surface 21 of the main upper 2M and the lateral side surface 22 of FIG. 1 are essentially non-stretching in the front direction Y1 and the rear direction Y2 of the foot and in the circumference direction R.

The tape materials 2*t* are a well-known structure, and are therefore not shown or simplified in FIGS. 1 to 6.

Figure 9:
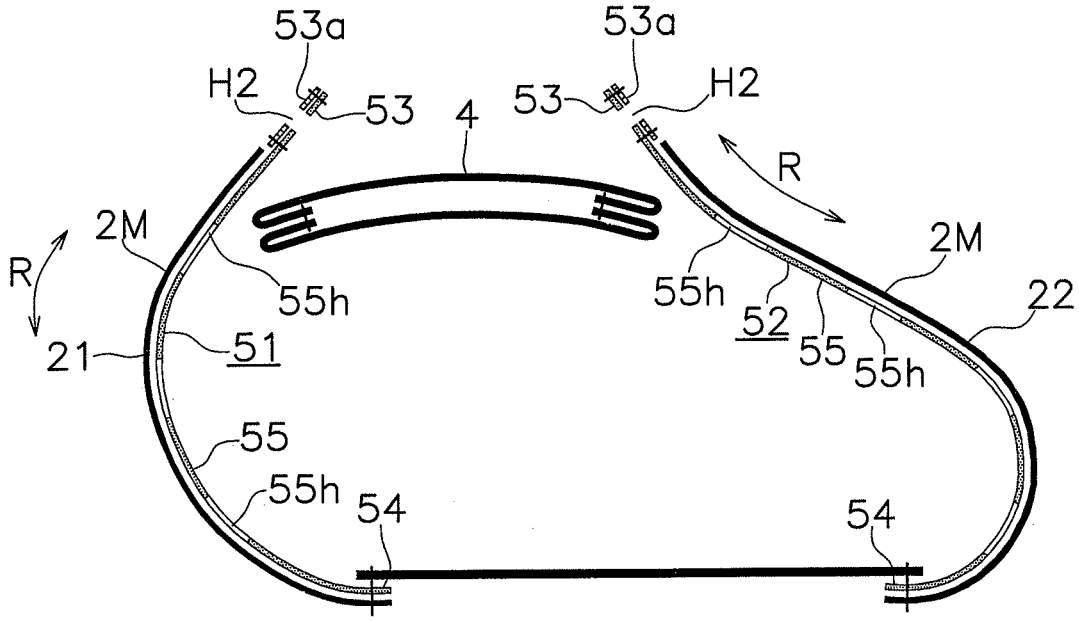
FIG. 9 is a cross-sectional view of the upper obtained by cutting the shoe of the embodiment in an area including the second eyelet and the side panel.

In FIG. 9, the side panels 51 and 52 include second eyelets H2. The side panels 51 and 52 each include a tip portion 53, a bottom portion 54 fixed to the sole 1 and the main upper 2M, and a middle portion 55 between the tip portion 53 and the bottom portion 54, which are continuous with one another as an integral member.

The tip portion 53 is connected to the main upper 2M and the sole 1 only via the middle portion 55 and the bottom portion 54. The bottom portion 54 may be sewn to the main upper 2M without being fixed to the sole 1.

In the tip portion 53, an eyelet member 53*a* is sewn to the tape material which forms a part of the side panels 51 and 52. In FIGS. 1 to 8, areas of the side panels 51 and 52 in which the eyelet member 53*a* is not provided are dotted.

The second eyelet H2 is a small hole formed in the tip portion 53 and the eyelet member 53*a*, which the shoelace 3 of FIG. 1 passes through and engages with.

While the first eyelets H1 and the second eyelets H2 are numbered in subscript from front to back in order to distinguish the eyelet positions in the front-back direction Y from one another in FIG. 1, the numbers in subscript are omitted in the description of the embodiments and in FIG. 2 and subsequent figures.

The first side panel 51 of FIG. 3 is formed in a band-like shape, and wraps around the medial side surface S1 of the foot in an upward or diagonally upward direction (a direction which slopes up in a front direction) along the medial side surface S1 in the space inside the main upper 2M, covering a portion of the medial side surface S1.

The second side panel 52 of FIG. 4 is formed in a band-like shape, and wraps around the lateral side surface S2 of the foot in an upward or diagonally upward direction along the lateral side surface S2 in the space inside the main upper 2M, covering a portion of the lateral side surface S2.

The middle portion 55 is arranged between the tip portion 53 and the bottom portion 54, and is not attached to the main upper 2M, as clearly shown in FIGS. 5 and 6. Therefore, the middle portion 55 allows the tip portion 53 to move in the front-back direction Y of the foot with respect to the bottom portion 54. On the other hand, the middle portion 55 of the side panels 51 and 52 forms the stretchable portion, and can stretch and shrink to increase the length from the tip portion 53 to the bottom portion 54.

The tape material of the side panels 51 and 52 and the eyelet member 53*a* are formed by an essentially non-stretching material.

However, as clearly shown in FIGS. 3 and 4, a plurality of circular through holes 55*h* are formed in a staggered pattern in the middle portion 55 of the side panels 51 and 52 of FIG. 5. When a substantial tensile force is applied in the direction in which the side panels 51 and 52 extend, the shapes of the through holes 55*h* deform into elliptic shapes, and the middle portion 55 extends in the circumference direction of the foot.

The second eyelet H2 on the medial side of FIG. 3 is arranged in an area from the MP joint $MP_1$ of the first toe f1 to the Lisfranc joint LJ of the first toe f1. Preferably, the second eyelet H2 on the medial side of the foot of FIG. 3 is arranged at a position posterior Y2 to the head $B4_1h$ of the metatarsal bone $B4_1$ of the first toe f1 and anterior Y1 to the base $B4_1b$ of the metatarsal bone $B4_1$ of the first toe f1.

On the other hand, the second eyelet H2 on the lateral side of FIG. 4 is preferably arranged at a position posterior Y2 to the head $B4_4h$ of the metatarsal bone $B4_4$ of the fourth toe f4 and anterior Y1 to the base $B4_4b$ of the metatarsal bone $B4_4$ of the fourth toe f4.

Preferably at least a pair of medial and lateral first eyelets H1, and more preferably a plurality of pairs of first eyelets H1, is provided on the front side Y1 of the second eyelet H2, as shown in FIGS. 3 and 4.

Preferably at least a pair of medial and lateral first eyelets H1, and more preferably a plurality of pairs of first eyelets H1, is provided on the rear side Y2 of the second eyelet H2.

The upper is fastened by the shoelace inserted through the first eyelets H1, thereby stabilizing the support.

The first side panel 51 of FIG. 3 extends from the bottom portion 54 toward the tip portion 53 in a diagonally forward and upward direction. The middle portion 55 of the first side panel 51 is arranged along an area that is posterior Y2 to the head $B4_1h$ of the metatarsal bone $B4_1$ of the first toe f1 and anterior Y1 to the base $B4_1b$ of the metatarsal bone $B4_1$ of the first toe f1 (the shaft of the metatarsal bone $B4_1$ of the first toe f1).

On the other hand, the second side panel 52 of FIG. 4 extends from the bottom portion 54 toward the tip portion 53 in a diagonally forward and upward direction. The middle portion 55 of the second side panel 52 is arranged along an area that is posterior Y2 to the head $B4_4h$ of the metatarsal bone $B4_4$ of the fourth toe f4 and anterior Y1 to the base $B4_4b$ of the metatarsal bone $B4_4$ of the fourth toe f4 (the shaft of the metatarsal bone $B4_4$ of the fourth toe f4).

Second Embodiment

Figure 10:
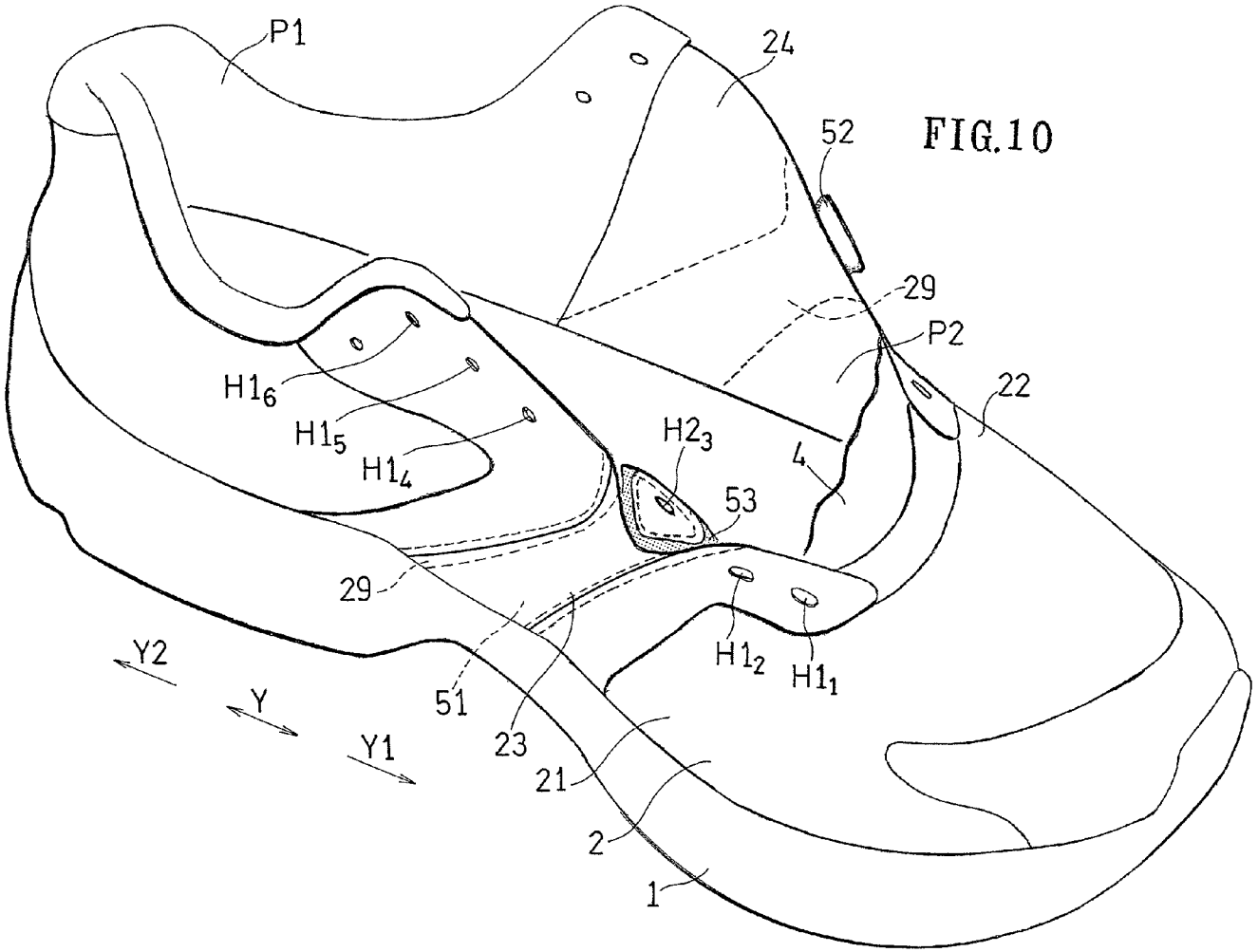
FIG. 10 is a schematic perspective view showing a shoe of a second embodiment.
Figure 11:
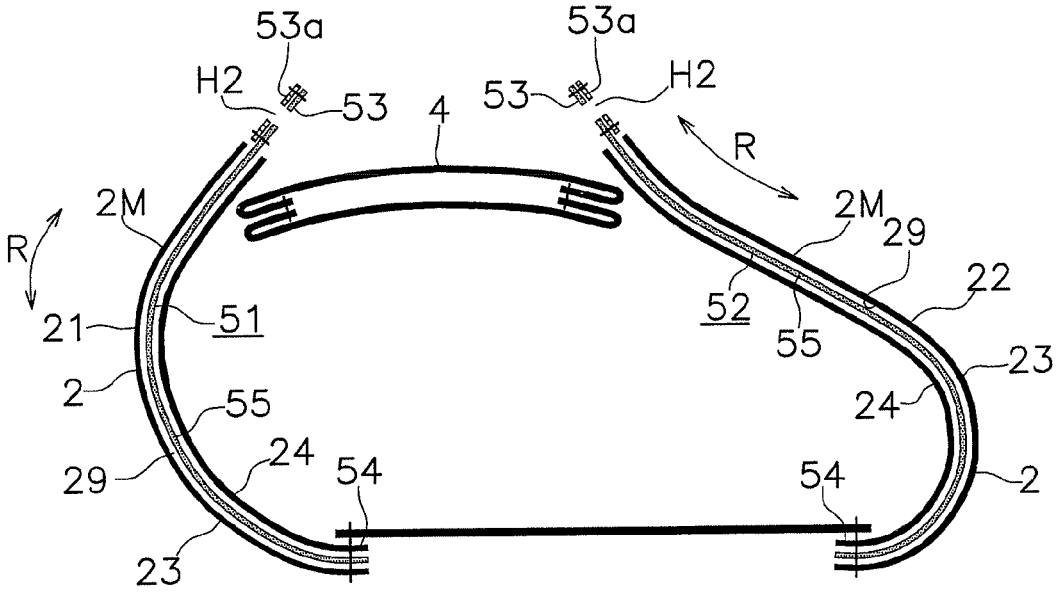
FIG. 11 is a cross-sectional view of the upper obtained by cutting the shoe of the embodiment in an area including the second eyelet and the side panel.

FIGS. 10 and 11 show a second embodiment.

In the second embodiment, the main upper 2M includes a bag-like housing 29 for accommodating the middle portion 55 of the side panels 51 and 52. The tip portion 53 of the side panels 51 and 52 protrudes from the housing 29.

The medial and lateral side surfaces 21 and 22 of the main upper 2M of FIG. 11 are each formed by sewing together a front surface material 23 and a back surface material 24 as shown in FIG. 10. The housing 29 is formed between the two members 23 and 24 sewn together.

The side panels 51 and 52 are each formed in a band-like shape that conforms to the shape of the housing 29.

The side panels 51 and 52 may have a stretchable portion including the through holes 55*h* formed in the middle portion 55, as in the first embodiment, or may be formed by a resin tape having rubber elasticity instead of forming the through holes 55*h*.

The term "rubber elasticity" means a property of being able to repeatedly stretch and shrink (elastically deform) without substantial plastic deformation, such as vulcanized rubber.

The configuration of the second embodiment is otherwise similar to that of the first embodiment, and like elements to those of the first embodiment are denoted by like reference numerals and will not be further described below.

Third Embodiment

Next, a third embodiment will be described with reference to FIGS. 12 to 15B.

In the third embodiment, the first eyelets H1 are provided in a first side edge portion 20A of the main upper 2M, whereas the second eyelet H2 is provided in a second side edge portion 20B which is continuous with the main upper 2M. An eyelet member 53*b* forming a portion of the second side edge portion 20B is surrounded by a stretchable portion 5.

Figure 12:
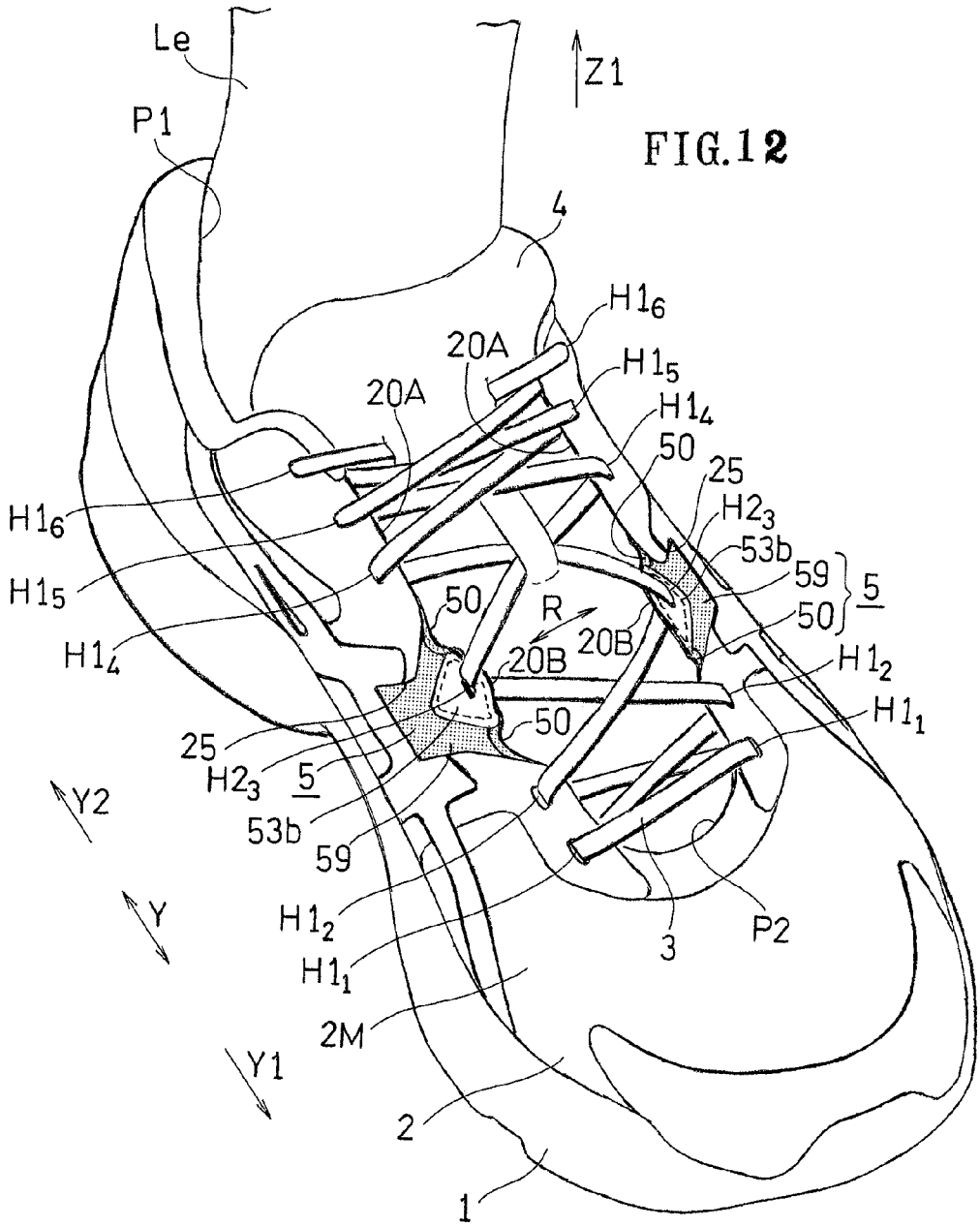
FIG. 12 is a schematic perspective view showing a shoe according to a third embodiment of the present invention.
Figure 13:
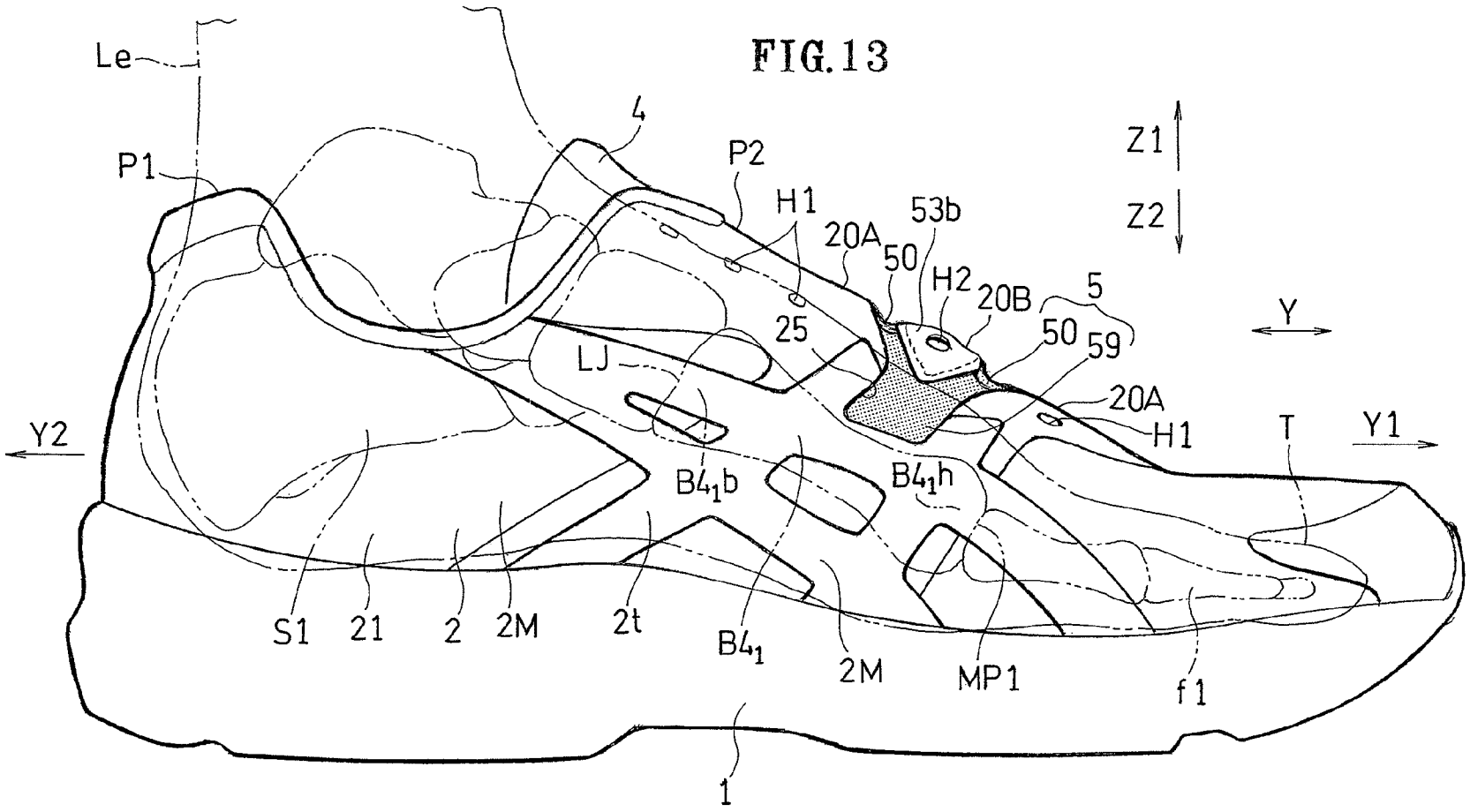
FIG. 13 is a schematic side view showing the relationship between the shoe of the embodiment and the foot bone structure as viewed from the medial side of the foot.
Figure 14:
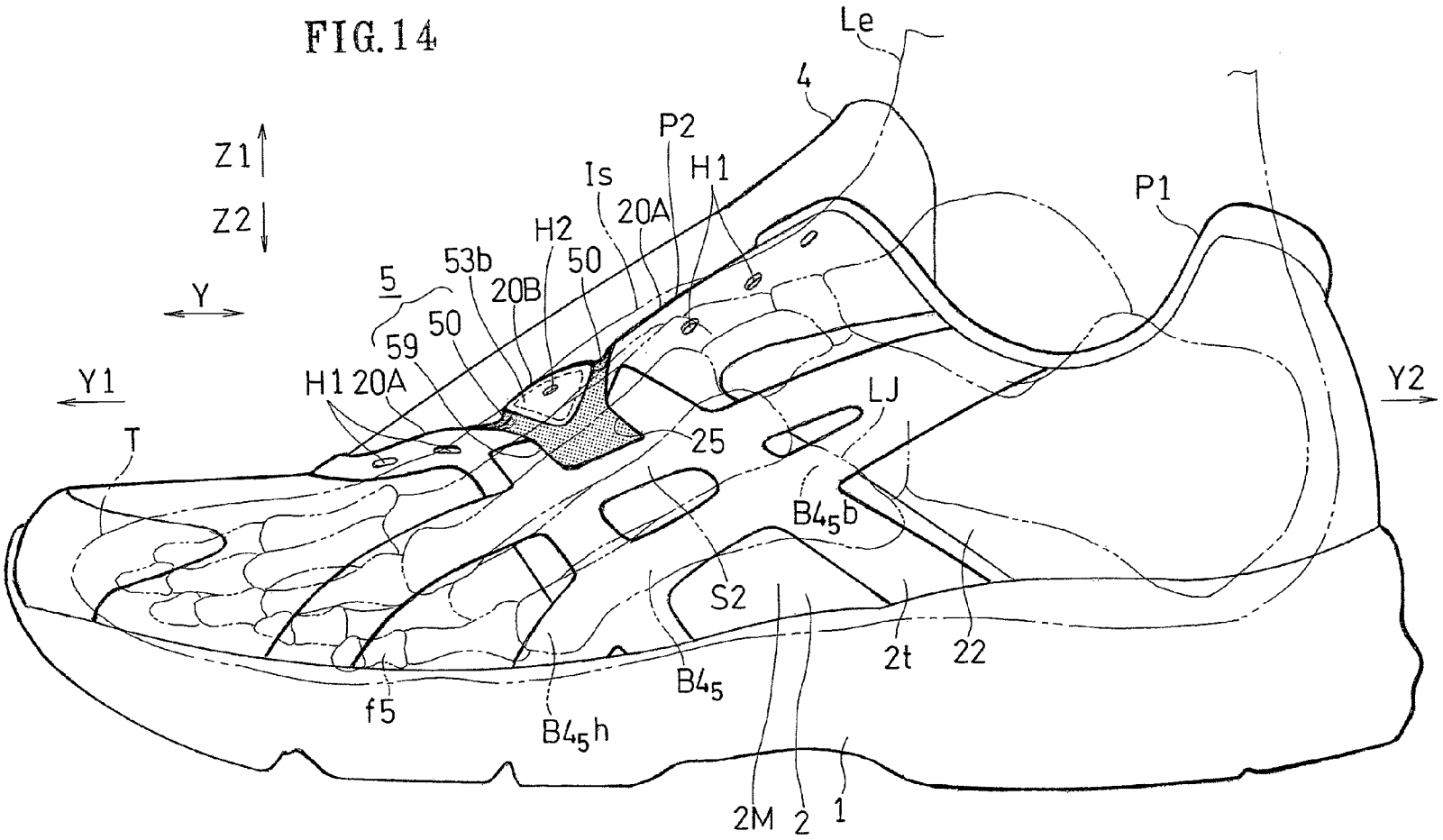
FIG. 14 is a schematic side view showing the relationship between the shoe of the embodiment and the foot bone structure as viewed from the lateral side of the foot.

In FIGS. 12 to 14, the area of the stretchable portion 5 is dotted. The pair of medial and lateral stretchable portions 5 and 5 opposes each other with the second opening P2 interposed therebetween.

Figure 15A:
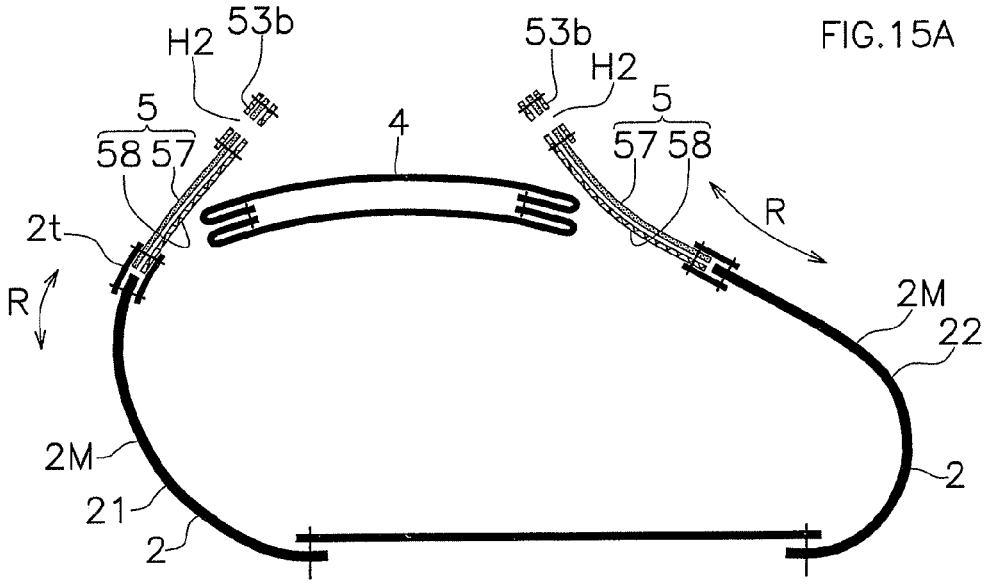
FIG. 15A is a cross-sectional view of the upper obtained by cutting the shoe of the embodiment in an area including the second eyelet and the stretchable portion.

A notch 25 is formed in the essentially non-stretching main upper 2M, and the stretchable portion 5 is formed in the area of the notch 25. The eyelet member 53*b* shown in FIG. 15A is sewn onto the members 57 and 58 forming the stretchable portion 5, and the second side edge portion 20B is an area where the members 57 and 58 and the eyelet member 53*b* overlap with each other, and is continuous with the main upper 2M only via the stretchable portion 5.

That is, the stretchable portion 5 of FIG. 12 surrounds the second side edge portion 20B, and if the stretchable portion 5 is compared to the sea and the main upper 2M to the land, the second side edge portion 20B is arranged as if it were an island off the main upper 2M which were the land. That is, the second side edge portion 20B is connected to the main upper 2M only via the stretchable portion 5.

The main upper 2M which is less stretchable than the stretchable portion 5 covers the Lisfranc joint LJ and the metatarsal bone base $B4_5b$ of the fifth toe f5 on the lateral side of the foot of FIG. 14, and the main upper 2M of FIG. 13 covers the base $B4_1b$ and the head $B4_1h$ of the metatarsal bone of the first toe f1 on the medial side of the foot.

As clearly shown in FIGS. 13 and 14, in the present embodiment, the stretchable portion 5 does not extend to the sole 1, with the main upper 2M being continuous to the front-back direction Y below the stretchable portion 5. Therefore, even with the stretchable portion 5 being easy-stretchable member, or even if the two stretchable portions 5 and 5 are arranged at positions opposing each other, the foot support is stable.

On the medial side of the foot, the main upper 2M may include a non-stretching member covering only one of the base $B4_1b$ and the head $B4_1h$ of the metatarsal bone of the first toe, with the other covered by a stretchable member.

As shown in FIG. 15A, the stretchable portion 5 may include a stretchable, meshed raw fabric 58 and a resin sheet 57 with rubber elasticity sewn together at the non-stretching tape material 2*t*.

Figure 15B:
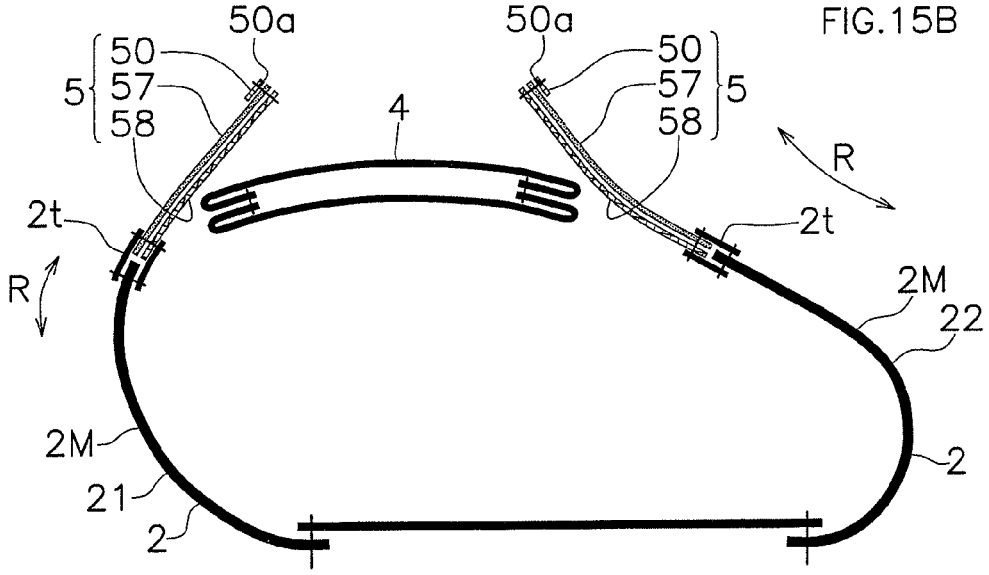
FIG. 15B is a cross-sectional view of the upper obtained by cutting the shoe of the embodiment in an area including the reinforcement material and the stretchable portion.

The stretchable portion 5 of FIG. 14 includes a first portion 50 which reinforces the stretchable portion 5 on the front side and the rear side of the second side edge portion 20B, and a second portion 59 which is the stretchable portion 5 other than the first portion 50. The first portion 50 is curved along the side edge of the stretchable portion 5, and is depressed as if it were notched. As shown in FIG. 15B, the first portion 50 is obtained by bonding and sewing a reinforcement material 50*a* onto the resin sheet 57. Although the reinforcement material 50*a* of the curved first portion 50 is formed by a material that is less stretchable than the second portion 59, it is capable of stretching in the front-back direction Y into a linear shape or shrinking by increasing its curvature, and forms a portion of the first portion 50. The first portion 50 suppresses the movement of the second side edge portion 20B in the front-back direction Y, thereby preventing the second eyelet H2 from moving with a small force in the front-back direction Y, or controls the maximum amount by which the second side edge portion 20B moves in the front-back direction. Therefore, the second eyelet H2 more easily moves in the circumference direction R than in the front-back direction Y.

The second portion 59 is stretchable both in the front-back direction Y and the circumference direction R.

In FIG. 12, the first portion 50 and the second portion 59 of the stretchable portion 5 are more stretchable than the side edge portions 20A and 20B and the main upper 2M and are arranged so that the vicinity of the second side edge portion 20B in the circumference direction, i.e., the second portion 59, is stretchable in the circumference direction R of the foot and the front-back direction Y when the foot is flexed and the first portion 50 is stretchable in the front-back direction Y on the front side Y1 and the rear side Y2 of the second side edge portion 20B, so that the second side edge portion 20B can move in the circumference direction R of the foot (not shown) and in the front direction Y1 and the rear direction Y2 with respect to the main upper 2M when the foot is flexed.

It is not necessary to provide the reinforcement material 50*a* forming the first portion 50.

The configuration of the third embodiment is otherwise similar to that of the first embodiment, and like elements to those of the first embodiment are denoted by like reference numerals and will not be further described below.

Fourth Embodiment

Next, a fourth embodiment will be described with reference to FIGS. 16 to 20.

In the fourth embodiment, the first eyelets H1 are provided in the first side edge portion 20A of the main upper 2M, and the second eyelet H2 is provided in the stretchable portion 5B on the lateral side, of the stretchable portions 5A and 5B on the medial side and lateral side.

The areas of the stretchable portions 5A and 5B are dotted.

Figure 18:
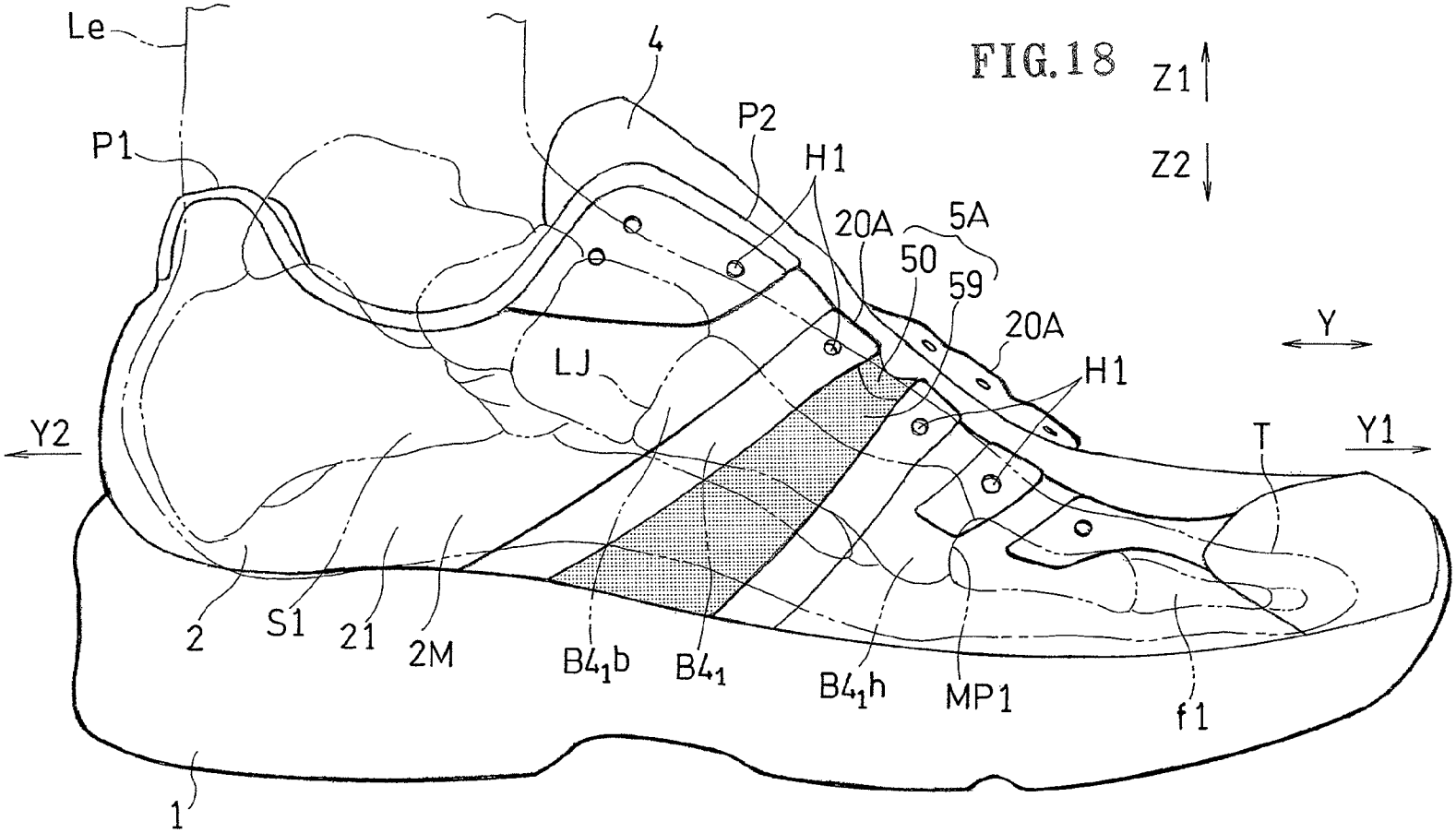
FIG. 18 is a schematic side view showing the relationship between the shoe of the embodiment and the foot bone structure as viewed from the medial side of the foot.

On the medial side of the foot of FIG. 18, the main upper 2M excluding the stretchable portion 5A, i.e., the main upper 2M that is less stretchable than the stretchable portions 5A and 5B, covers the base B$\mathbf{4}_1 b$ and the head B$\mathbf{4}_1 h$ of the metatarsal bone of the first toe f1. On the other hand, the main upper 2M covers the Lisfranc joint LJ of the fifth toe f5 and the metatarsal bone base B$\mathbf{4}_5 b$ on the lateral side of the foot of FIG. 19.

Figure 16:
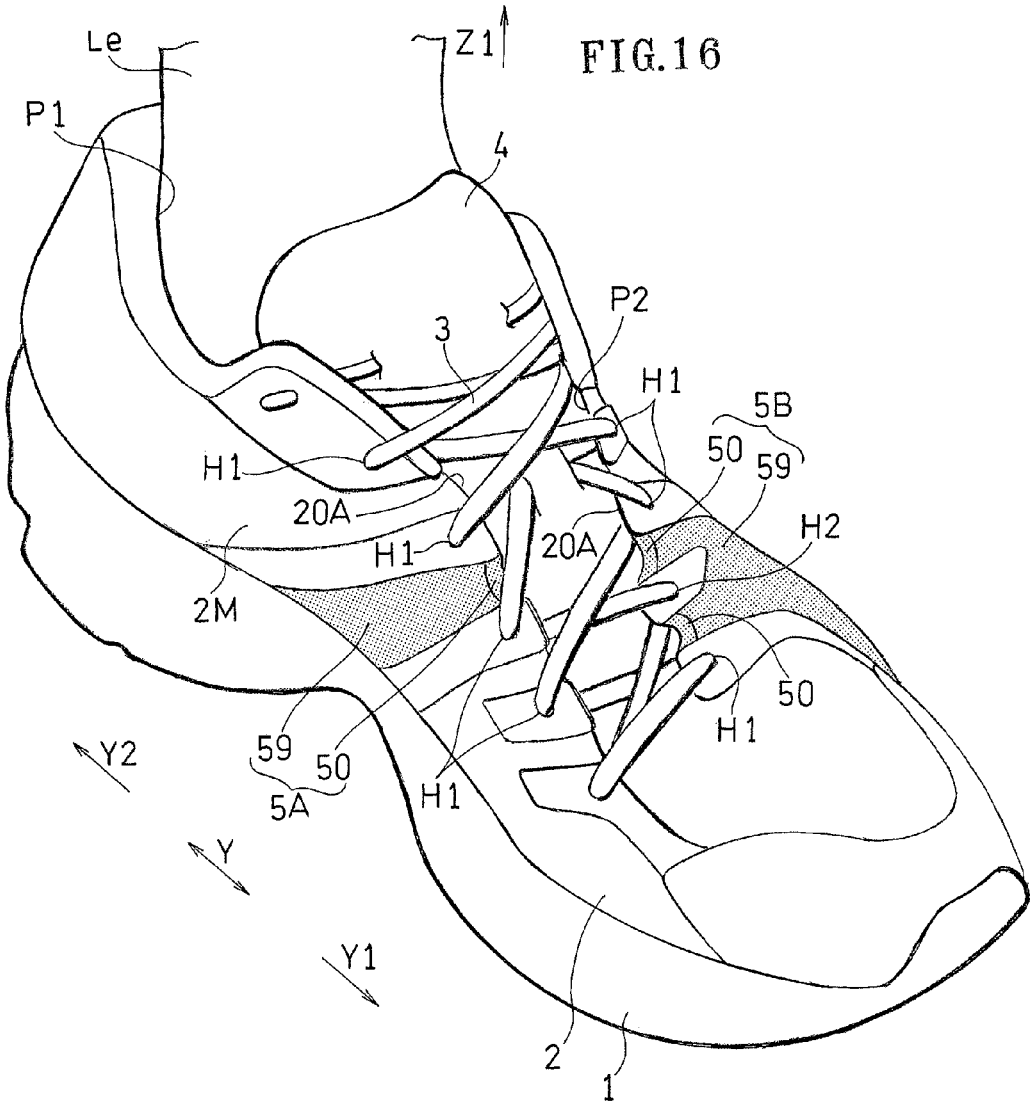
FIG. 16 is a schematic perspective view showing a shoe of a fourth embodiment of the present invention as viewed from the medial-front side of the shoe.
Figure 17:
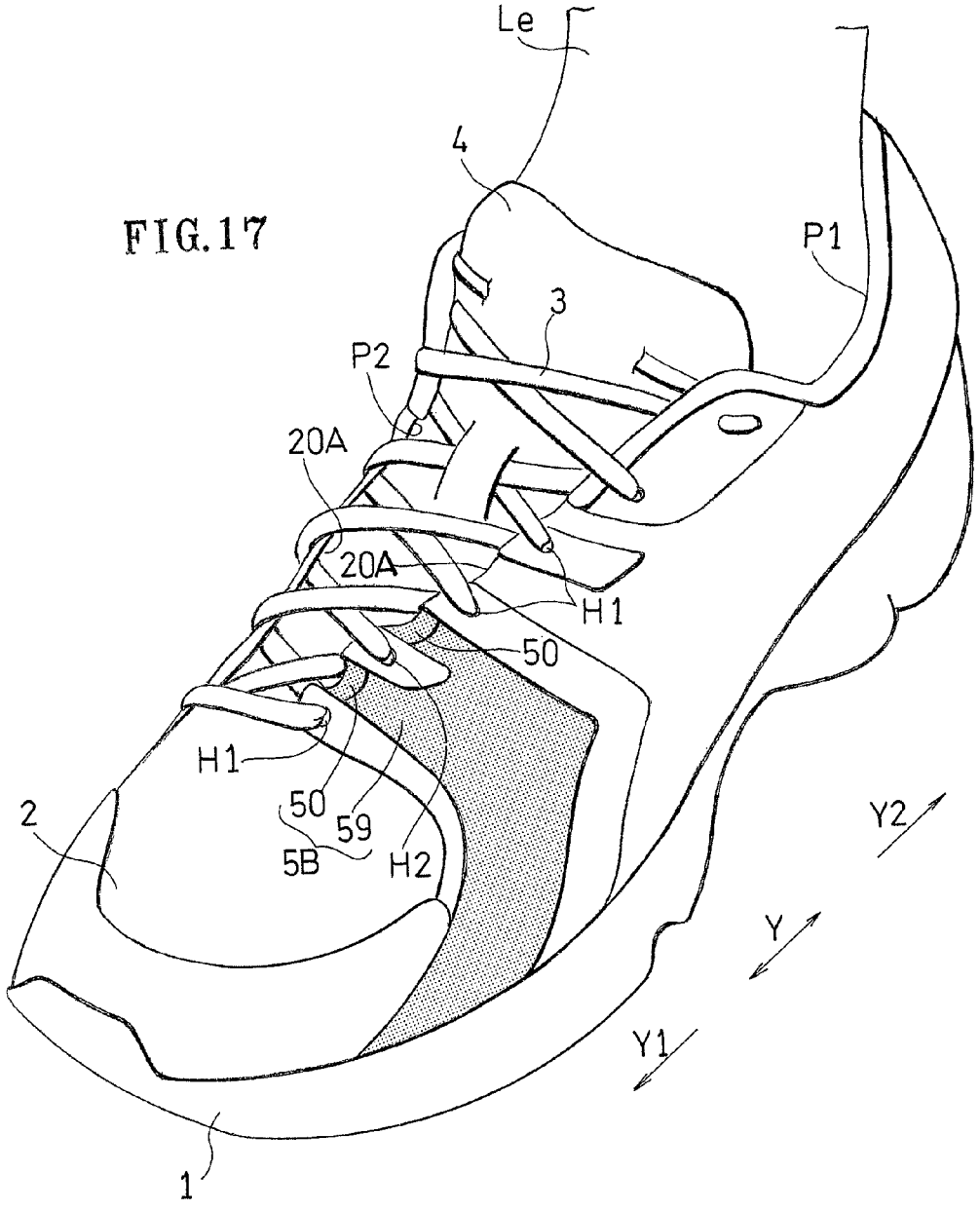
FIG. 17 is a schematic perspective view showing the shoe of the embodiment as viewed from the lateral-front side.

As shown in FIG. 16, the stretchable portion 5A and the stretchable portion 5B are arranged at positions diagonally across from each other with the second opening P2 therebetween. The stretchable portions 5A and 5B of FIGS. 17 and 18 extend across the medial and lateral side surfaces of the upper 2.

Figure 19:
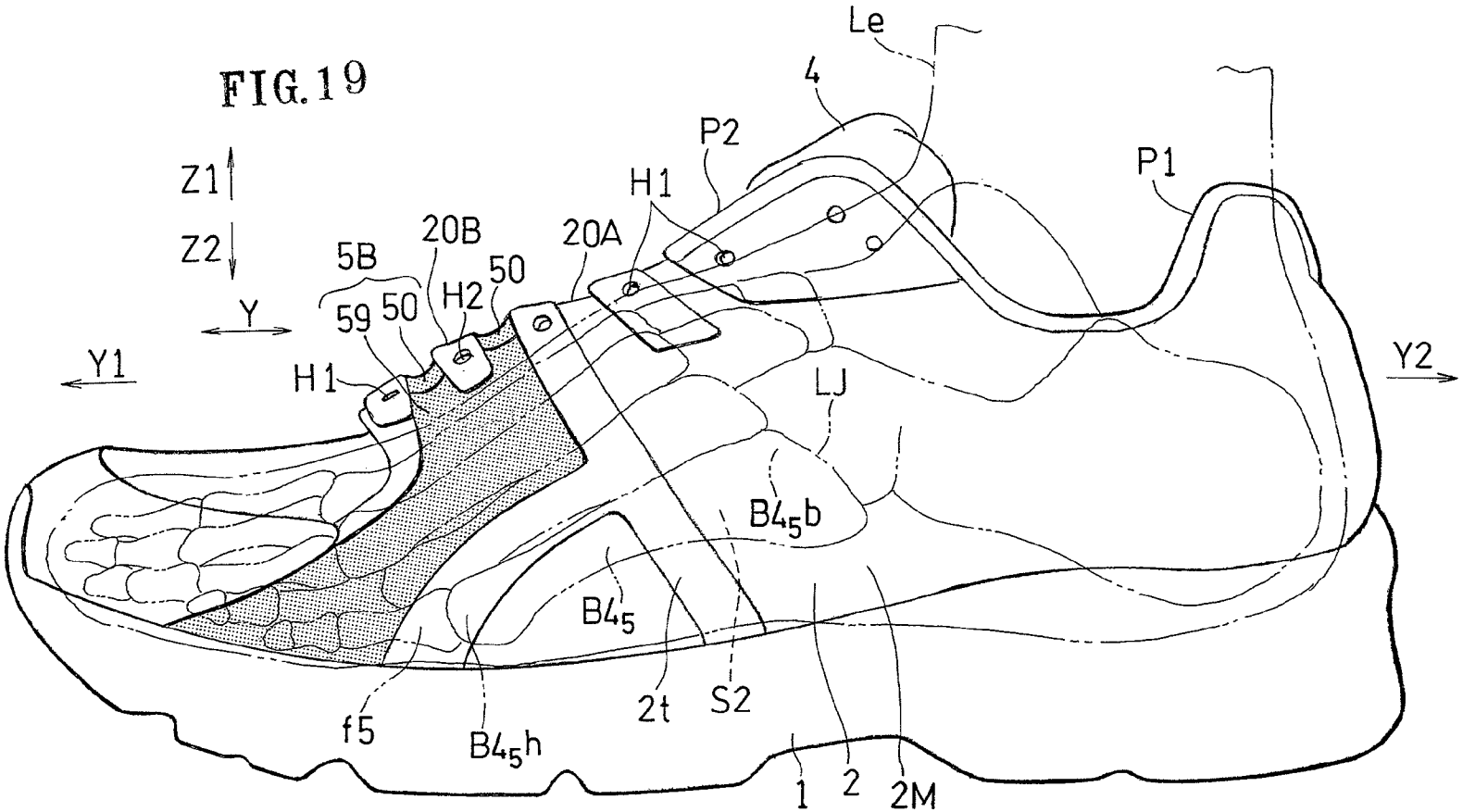
FIG. 19 is a schematic side view showing the relationship between the shoe of the embodiment and the foot bone structure as viewed from the lateral side of the foot.
Figure 20A:
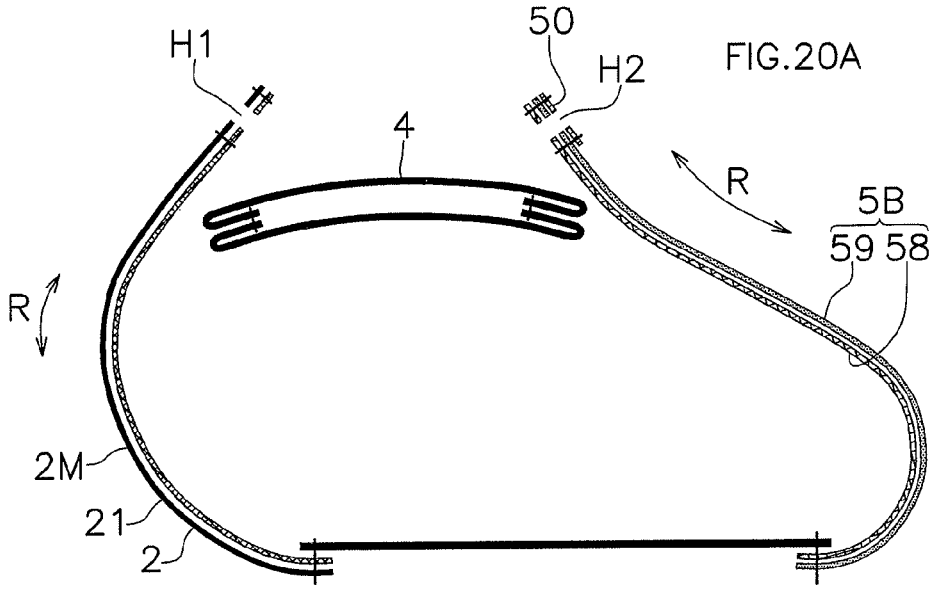
FIG. 20A is a cross-sectional view of the upper obtained by cutting the shoe of the embodiment in an area of the stretchable portion including the second eyelet.
Figure 20B:
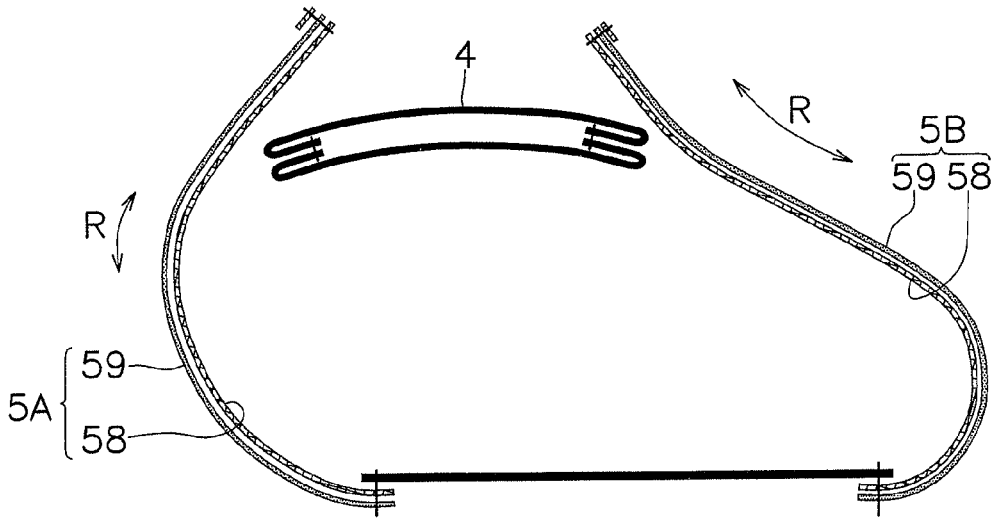
FIG. 20B is a cross-sectional view of the upper obtained by cutting the shoe of the embodiment in an area of the stretchable portion including the reinforcement portion.

As shown in FIGS. 18 and 19, the first portion 50 is provided at the upper end of the stretchable portions 5A and 5B. The first portion 50 of the stretchable portion 5B allows and controls the movement of the second side edge portion 20B in the front-back direction Y and will unlikely prevent the movement of the second side edge portion 20B in the circumference direction R (not shown).

Thus, the second eyelet H2 moves more easily in the circumference direction R than in the front-back direction Y.

The configuration of the fourth embodiment is otherwise similar to that of the first embodiment, and like elements to those of the first embodiment are denoted by like reference numerals and will not be further described below.

Next, test results on test examples and a reference example will be shown in order to make clear the advantages of the present invention.

First, shoes of Test Examples 1 to 4 and the reference example were provided.

Test Example 1

Shoes of Embodiment 1 shown in FIGS. 1 to 9 were produced as Test Example 1.

Test Example 2

Shoes of Embodiment 2 shown in FIGS. 10 and 11 were produced as Test Example 2. In Test Example 2, a material having a relatively low rigidity was employed for the side panel.

Test Example 3

Shoes of Embodiment 2 shown in FIGS. 10 and 11 were produced as Test Example 3. In Test Example 3, a material having a relatively high rigidity and rubber elasticity was employed for the side panel, and through holes were formed in a staggered pattern in the side panel.

Test Example 4

Shoes of Embodiment 4 shown in FIGS. 16 to 20 were produced as Test Example 4.

Reference Example

In Embodiment 3 shown in FIGS. 12 to 15, the reverse surface of the stretchable material in the area corresponding to the stretchable portion was backed with an essentially non-stretching woven fabric, and it was used as the reference example. In this reference example, the area corresponding to the stretchable portion is essentially non-stretching.

Markers were attached to the vicinity of the eyelets of the shoes of the test examples and the reference example, and the shoes were put on the foot as shown in FIG. 7 to measure the following distances $D_1$ to $D_6$.

$D_1$ is the distance between markers attached to the vicinity of the first eyelets H$\mathbf{1}_1$ on the medial side and the lateral side.

$D_2$ is the distance between markers attached to the vicinity of the first eyelets H$\mathbf{1}_2$ on the medial side and the lateral side.

$D_3$ is the distance between markers attached to the vicinity of the second eyelets H$\mathbf{2}_3$ on the medial side and the lateral side.

$D_4$ is the distance between markers attached to the vicinity of the first eyelets H$\mathbf{1}_4$ on the medial side and the lateral side.

$D_5$ is the distance between markers attached to the vicinity of the first eyelets H$\mathbf{1}_5$ on the medial side and the lateral side.

$D_6$ is the distance between markers attached to the vicinity of the first eyelets H$\mathbf{1}_6$ on the medial side and the lateral side.

Then, the distance between markers was measured while raising the heel by dorsally flexing the MP joint as shown in FIG. 8 from the state of FIG. 7 so as to obtain the distance $D_i$ between markers for every 20-mm raise of the heel. This measurement was performed for the test examples and the reference example.

For the samples, the amounts of change $\Delta D_1$ to $\Delta D_6$ of $D_1$ to $D_6$ were calculated, and the results are shown in FIGS. 21A to 21C and 22A and 22B for each sample.

The results will be discussed below.

Figure 21A:
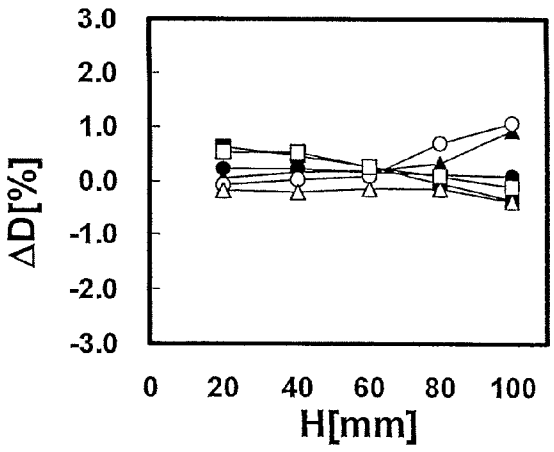
FIGS. 21A, 21B and 21C are graphs showing the relationship between the amount of heel raise H and the amount of change ΔD in the inter-eyelet distance for the shoes of Test Examples 1, 2 and 3, respectively.
Figure 21B:
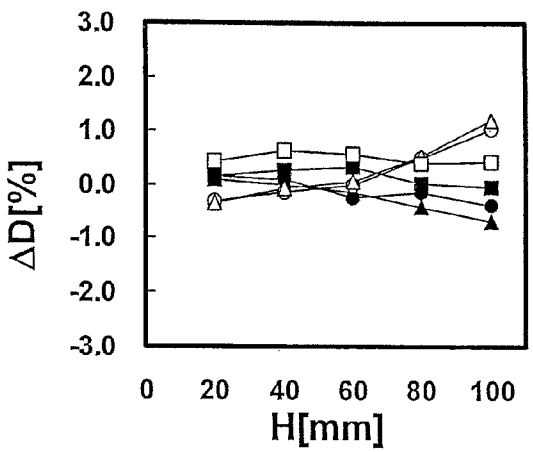
Figure 21C:
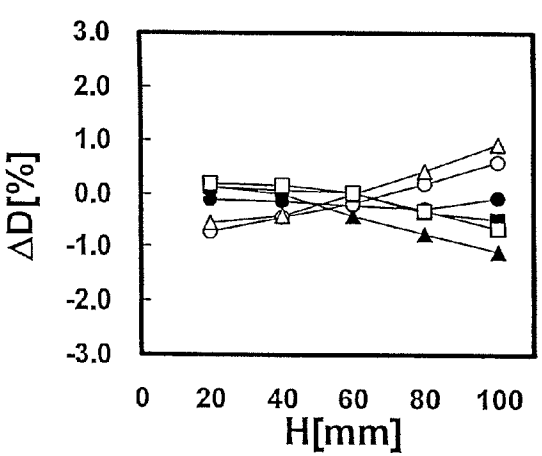
Figure 21C:
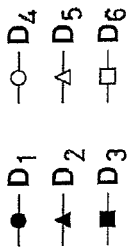
Figure 22A:
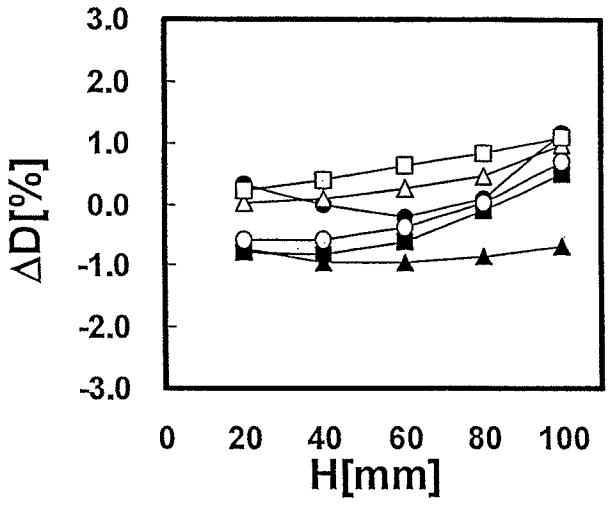
FIGS. 22A and 22B are graphs showing the relationship between the amount of heel raise H and the amount of change ΔD in the inter-eyelet distance for the shoes of Test Example 4 and a reference example, respectively.
Figure 22B:
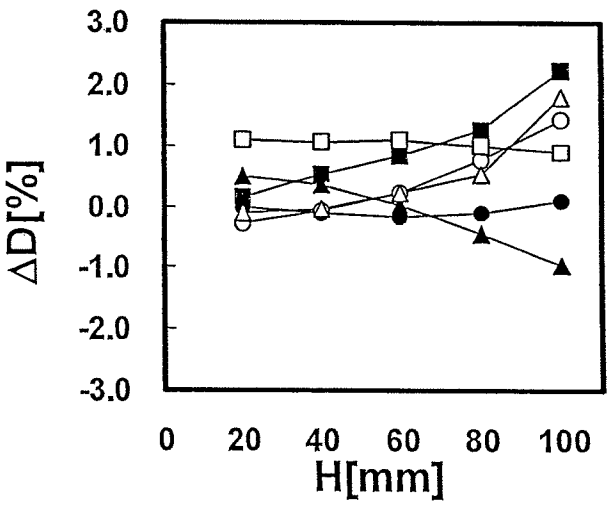
Figure 22B:
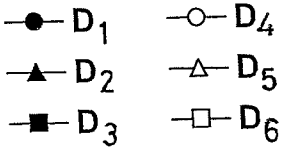

In the reference example of FIG. 22B, the amount of change $\Delta D_3$ in the distance between the second eyelets H$\mathbf{2}_3$ was over 2%. On the other hand, the $\Delta D_3$ was about ±0.5% or less in the test examples of FIGS. 21A to 21C and 22A.

It is believed that this is because the stretchable portion stretched in accordance with the change in foot circumference which occurred when the heel of FIG. 8 was raised.

The sum $\Sigma\Delta D$ of the amounts of change $\Delta D_1$ to $\Delta D_6$ (the total amount of absolute values of the amounts of change $\Delta D_i$) of the reference example is larger than those $\Sigma\Delta D$ of the test examples. It is considered that this is because when the heel of the foot is raised, the extensor hallucis longus muscle present in the area corresponding to the distances $D_3$ to $D_6$, the navicular bone, and the medial, middle, and lateral cuneiform bones project forward from the instep, thereby extending the distances $D_3$ to $D_6$, and shortening the distance $D_2$ in the vicinity of the MP joint due to the extension of the distances $D_3$ to $D_6$.

On the other hand, in the reference example, the amount of change when the heel is raised by 80 mm to 100 mm is largest for the distance $D_3$, among the amounts of change $\Delta D_1$ to $\Delta D_6$. While the inter-eyelet distances $D_1$ and $D_2$ on the front side of the second eyelet $H2_3$ tend to change in the negative direction, the inter-eyelet distances $D_4$ to $D_6$ on the rear side of the second eyelet $H2_3$ strongly tend to change in the positive direction. Thus, it is presumed that the second eyelet H2 is most preferably provided in the area of the second eyelet $H2_3$ of FIG. 1, i.e., the area of the shafts of the first to fifth metatarsal bones.

It can be seen that the sum $\Sigma\Delta D$ of the amounts of change for Test Examples 1 to 3 shown in FIGS. 21A to 21C where a stretchable portion is used in the pair of side panels is smaller than that $\Sigma\Delta D$ of Test Example 4 of FIG. 22A where a stretchable portion is used in the main upper of the upper. It can be seen that this phenomenon is particularly pronounced for amounts of heel raise H between 20 mm and 80 mm.

The reason for this will be discussed.

When the heel is raised as shown in FIG. 8 from the state of FIG. 7, the central portion of the tongue 4 is pushed by the instep, thereby urging the interval between the second eyelets $H2_3$ of FIG. 1 and the interval between the first eyelets $H1_5$ above to expand. Then, not only does the middle portion 55 of the side panel 51 (52) extend along the circumference direction of the foot, but the tip portion 53 of the side panel 51 also moves in the front-back direction Y. For example, the distances Dy1 and Dy2 between the second eyelet H2 and the adjacent first eyelets H1 of FIG. 7 both change after the flexion, as can be seen from the comparison between FIG. 7 and FIG. 8. That is, Dy2 is shortened and Dy1 is increased upon flexion.

Thus, as the tip portion 53 of the side panel moves in the front-back direction Y, the distance from the second eyelet H2 of FIG. 1 to the next first eyelet $H1_2$ and the next first eyelet $H1_4$ changes. It is presumed that the change in the distance $D_i$ between the first eyelets $H1_i$ is also decreased due to the change in the distance in the front-back direction Y.

It is presumed that another reason why the sum $\Sigma\Delta D$ of the amounts of change in Test Example 1, 2 or 3 is smaller than the sum $\Sigma\Delta D$ of amounts of change of Test Example 4 is that the second eyelets are provided at two locations in Test Examples 1 to 3 whereas the second eyelet is provided at only one location in Test Example 4.

The sum $\Sigma\Delta D$ of amounts of change of Test Example 1 where the side panels are provided so as to be in contact with the medial and lateral side surfaces of the foot is smaller than the sum $\Sigma\Delta D$ of amounts of change of Test Examples 2 and 3 where the side panels are provided in the bags of the upper. It is presumed that the reason is that the side panel of Test Example 1 more easily moves in the front-back direction than the side panel in the bag of Test Example 2, and the side panel can immediately deform in response to a change in the shape of the foot.

Next, tests conducted for the preferred number and positions of the second eyelets will be shown.

Figure 26A:
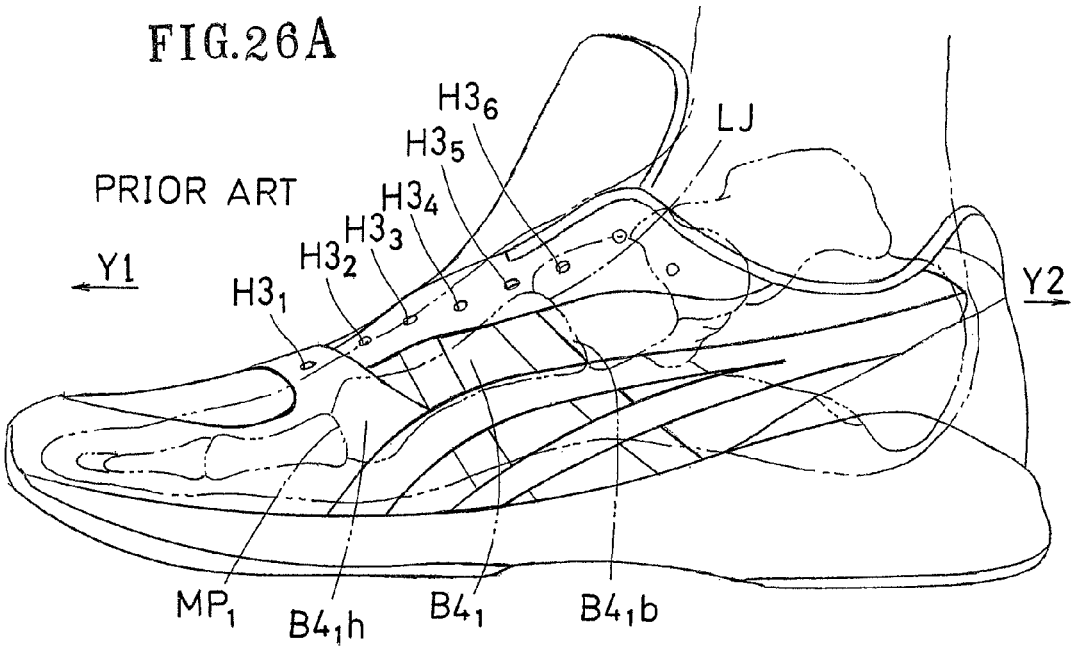
FIGS. 26A and 26B are a medial side view and a lateral side view, respectively, showing the positional relationship between the eyelets and the foot bone structure for the shoe used in Test Examples 11 to 17.

First, Test Examples 11 to 17 to be shown below were provided, which all use the athletic shoes shown in FIGS. 26A and 26B but are different from one another only in the shoelace. In the shoe of FIG. 26A, the positions of the eyelets $H3_1$ and $H3_2$ correspond to the positions of the first eyelets $H1_1$ and $H1_2$ of the shoe of FIG. 3, and the positions of the eyelets $H3_5$ and $H3_6$ of FIG. 26A correspond to the positions of the first eyelets $H1_4$ and $H1_5$ of FIG. 3. The second eyelet $H2_3$ of FIG. 3 corresponds to the position between the eyelets $H3_3$ and $H3_4$ of FIG. 26A. The number of eyelets was set to six so as to match with the aforementioned tests.

FIGS. 23A to 23G are conceptual plan views showing shoelaces used in Test Examples 11 to 17. In these plan views, the eyelets $H3_1$ to $H3_6$ are all first eyelets, and each pair of the eyelets $H3_1$ to $H3_6$ were fastened using an ordinary non-stretchable shoelace 31 or a stretchable rubber-thread-like stretchable shoelace 32. In the figure, a thick line denotes an ordinary non-stretchable shoelace 31, and a thin line denotes a rubber-thread-like stretchable shoelace 32.

For example, in Test Example 11, only the first eyelets $H3_3$ to $H3_3$ were fastened with the stretchable shoelace 32, while the first eyelets $H3_1$ to $H3_2$ were fastened with a non-stretchable shoelace and the first eyelets $H3_4$ to $H3_6$ with another non-stretchable shoelace. The stretch of the stretchable shoelace 32 was set to about 15% or less.

The stretchable shoelace 32 allows the gap between first eyelets to expand, and it is therefore assumed that the area of first eyelets connected together with the stretchable shoelace 32 will have a similar behavior to that where second eyelets are provided. Based on such an assumption, the following tests were conducted.

A sensual test was conducted, in which four test subjects wore each of the shoes of Test Examples 11 to 17 to examine whether the foot is stably held by the shoe when raising the heel of the foot.

As the results of this sensual test, evaluation scores were calculated for each of Test Examples 11 to 16 by the well-known pairwise comparison (AHP) method. The calculation results are shown in the bar graph of FIG. 24.

Figure 24:
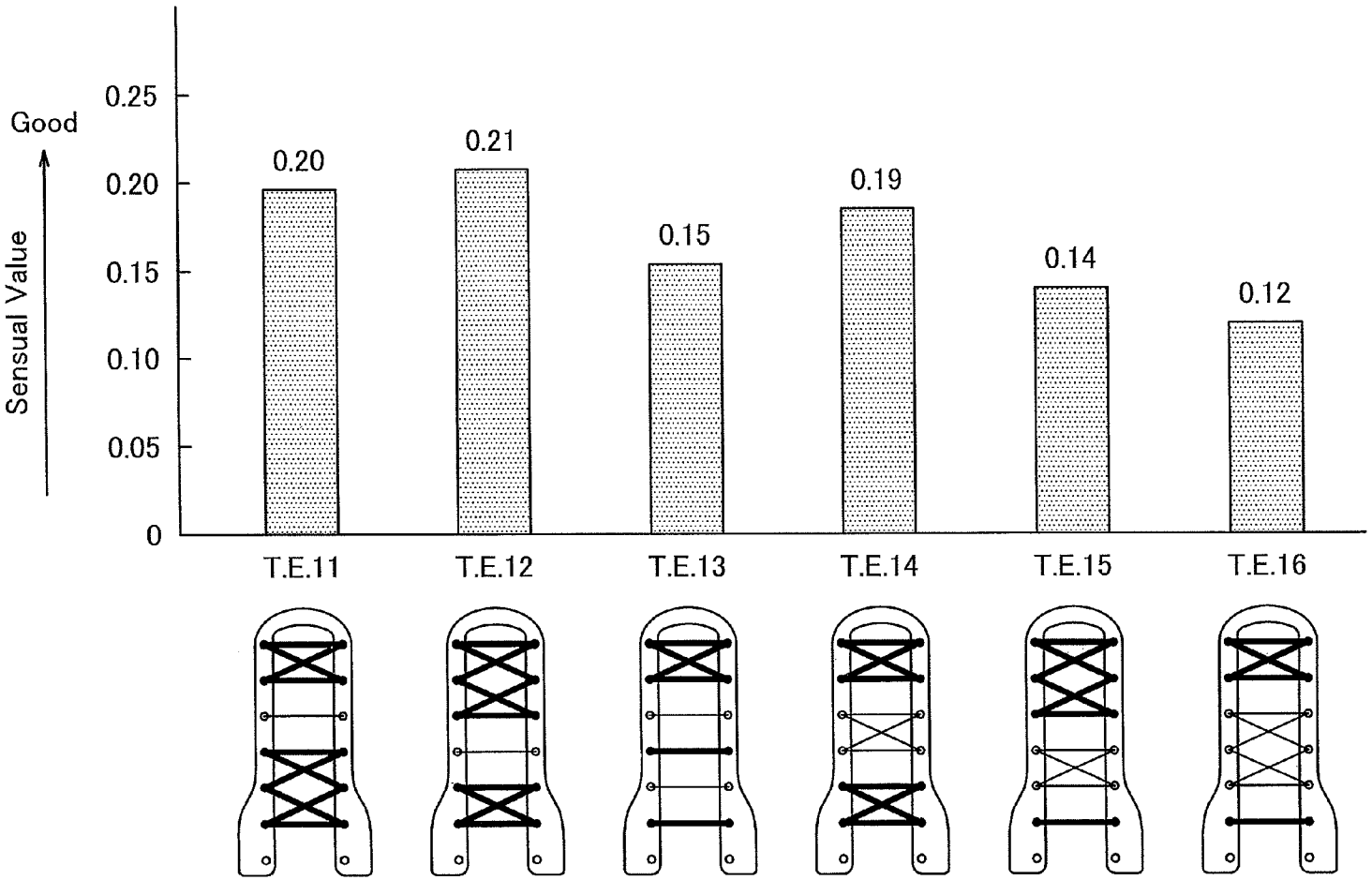
FIG. 24 is a graph showing the results of a sensual test.

As can be seen from the graph of FIG. 24, the foot can be stably held in Test Examples 11, 12 and 14 exhibiting high evaluation scores, where the stretchable shoelace 32 is provided only on the eyelets $H3_3$ and/or $H3_4$. The evaluation score is higher when the stretchable shoelace 32 is provided on one of the eyelets $3_3$ and $3_4$, as compared with a case where it is provided on both of the eyelets $3_3$ and $3_4$. Thus, it will be possible to more stably support the foot when one, rather than two, of the second eyelets H2 is provided on each side.

On the other hand, Test Examples 13, 15 and 16 where the stretchable shoelace 32 is provided on the eyelets $H3_5$ exhibit lower scores, indicating that the foot cannot be held stably.

It can be seen that the holding of the foot is unstable particularly when the stretchable shoelace 32 is provided across the three eyelets $H3_3$ to $H3_5$.

Next, the distances $D_1$ to $D_6$ were measured as in Test Examples 1 to 4 described above, while markers were attached to the vicinity of the eyelets of the shoes of Test Examples 11, 12, 17 and 16 and the shoes were worn on feet. The results are shown in FIGS. 25A to 25D.

The results will be discussed below.

As can be seen from the graphs of FIGS. 25A to 25D, Test Examples 11 and 12 where the stretchable shoelace 32 was provided on the eyelets $H3_3$ or $H3_4$ showed smaller changes in the inter-eyelet distances $D_4$ to $D_6$ as compared with those of Test Examples 17 and 16 where the stretchable shoelace 32 was provided on the eyelets $H3_5$.

Particularly, Test Example 11 where only the eyelets $H3_3$ were fastened with the stretchable shoelace 32 showed small changes in the inter-eyelet distances $D_1$ to $D_6$.

Figure 26B:
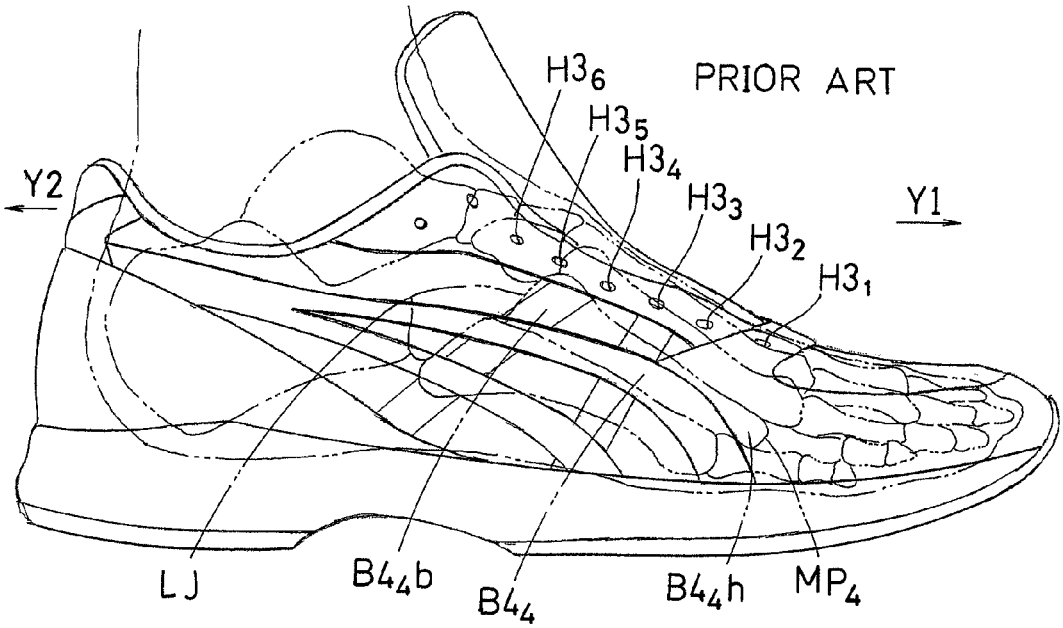

Now, observing the positions, relative to the foot bone structure, of the eyelets $H3_1$ to $H3_6$ of the upper 2 shown in FIGS. 26A and 26B used in Test Examples 11 to 17 shows that the eyelets $H3_3$ and $H3_4$ are arranged at positions posterior Y2 to the metatarsal phalangeal joint MP1 of the first toe and anterior Y1 to the base $B4_1B$ of the metatarsal bone of the first toe on the medial side of the foot while being arranged at positions posterior Y2 to the metatarsal phalangeal joint MP4 of the fourth toe and anterior Y1 to the base $B4_4b$ of the metatarsal bone of the fourth toe on the lateral side.

Therefore, it is presumed that the stable holding of the foot and the fitness property in response to changes in the foot circumference are maximized when the second eyelets H2 are provided only in these areas.

Figure 23A:
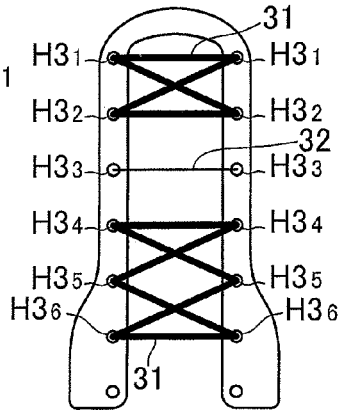
FIGS. 23A, 23B, 23C, 23D, 23E, 23F and 23G are plan views showing an area corresponding to the second eyelet of Test Examples 11, 12, 13, 14, 15, 16 and 17, respectively.
Figure 23B:
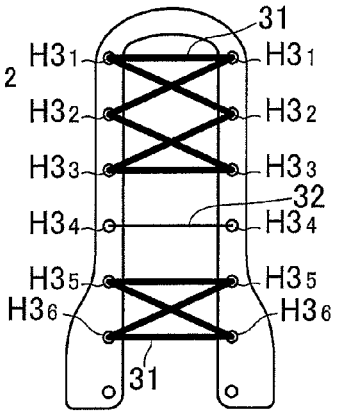
Figure 23C:
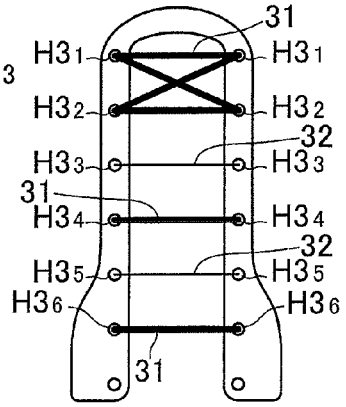
Figure 23D:
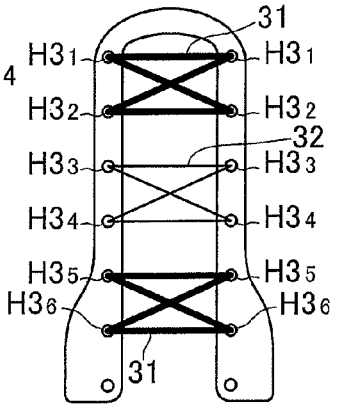
Figure 23E:
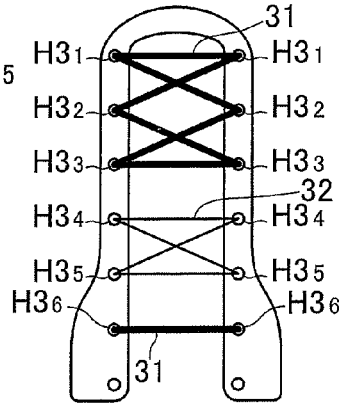
Figure 23F:
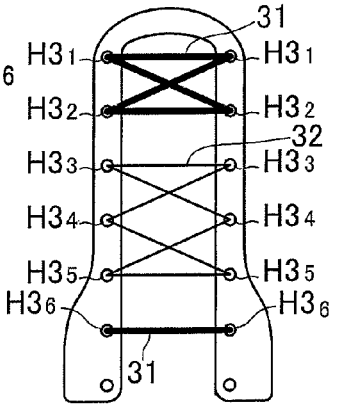
Figure 23G:
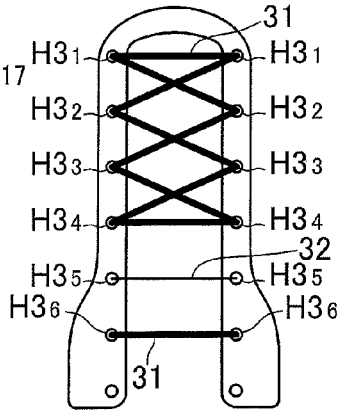
Figure 25A:
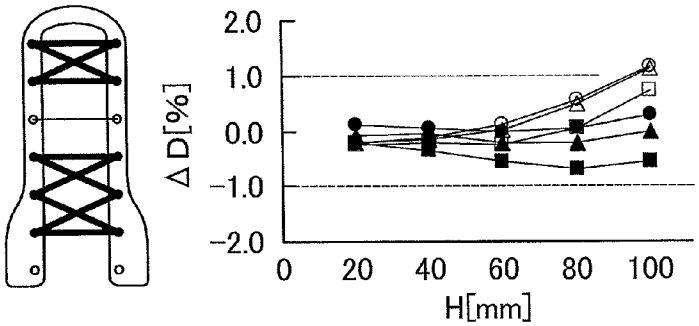
FIGS. 25A, 25B, 25C and 25D are graphs showing the relationship between the amount of heel raise H and the amount of change ΔD in the inter-eyelet distance for the shoes of Test Examples 11, 12, 17 and 16, respectively.
Figure 25B:
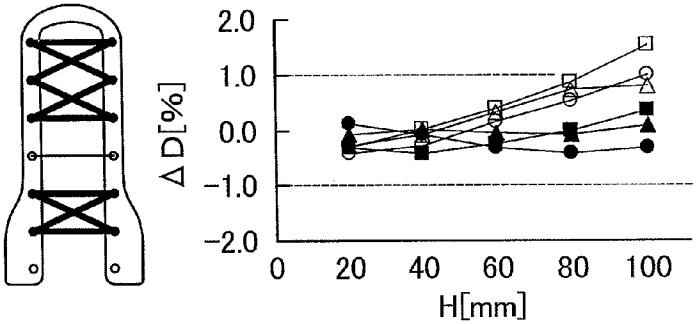
Figure 25C:
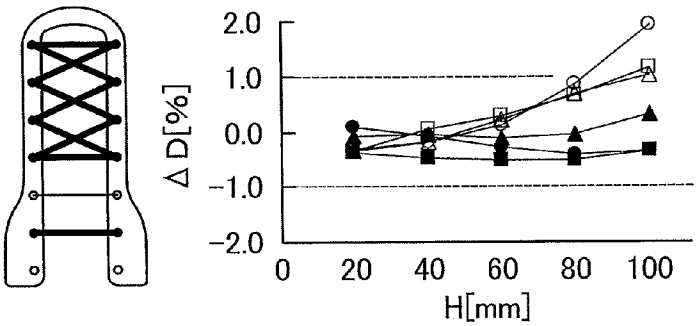
Figure 25D:
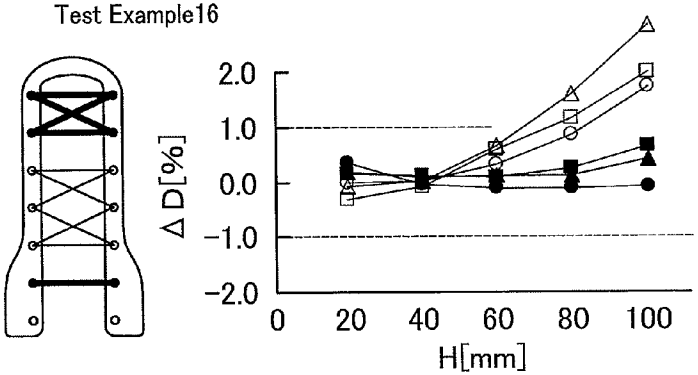
Figure 25D:
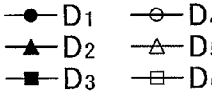

On the other hand, with Test Example 16 where three eyelets $H3_3$ to $H3_5$ are connected together by the stretchable shoelace 32 as shown in FIG. 23F, the expansion of the inter-eyelet distances $D_4$ to $D_6$ is significantly excessive and it is not possible to stably hold the foot, as can be seen from FIGS. 24 and 25D. Therefore, in the sixth patent document (Nakano), it is presumed that the function of stably holding the foot significantly lowers when the side panel is formed by a rubber or a stretchable fabric.

While preferred embodiments have been described above with reference to the drawings, various obvious changes and modifications will readily occur to those skilled in the art upon reading the present specification.

For example, the side panel may be provided along the outer surface of the main upper. The stretchable portion of the side panel may be provided only on one of the medial side surface and the lateral side surface of the foot.

A pair of side panels may be provided, with the stretchable portion provided only in one of the pair of side panels, and the positions of the side panels may be arranged while being staggered from each other in the front-back direction (diagonally opposing each other).

A pair of side panels with no stretchable portion may be provided, with stretchable portions provided in portions of the upper other than the side panels. In such a case, not only do second eyelets provided with stretchable portions move, but also first eyelets provided in the side panels move in the front-back direction.

The first portion may be formed by a material having rubber elasticity, and in such a case it may be provided in a linear pattern in the front-back direction. It is not always necessary to provide the first portion.

Thus, such changes and modifications are deemed to fall within the scope of the present invention, which is defined by the appended claims.

INDUSTRIAL APPLICABILITY

The present invention is applicable to a shoe having a shoelace for fitting an upper of the shoe to the foot.

DESCRIPTION OF THE REFERENCE NUMERALS

1: Sole
2: Upper
2M: Main upper
2*t*: Tape material
20: Side edge portion
20A: First side edge portion
20B: Second side edge portion
21: Medial side surface
22: Lateral side surface
23: Front surface material
24: Back surface material
25: Notch
29: Housing
3: Shoelace
4: Tongue
5: Stretchable portion
5A: Stretchable portion
5B: Stretchable portion
50: First portion
50*a*: Reinforcement material
59: Second portion
51: First side panel
52: Second side panel
53: Tip portion (of side panel)
53*a*: Eyelet member
53*b*: Eyelet member
54: Bottom portion (of side panel)
55: Middle portion (of side panel)
55*h*: Through hole
B: Back surface
$B4_1$: Metatarsal bone of first toe
$B4_1h$: Head (of metatarsal bone of first toe)
$B4_1b$: Base (of metatarsal bone of first toe)
$B4_5$: Metatarsal bone of fifth toe
$B4_5h$: Head (of metatarsal bone of fifth toe)
$B4_5b$: Base (of metatarsal bone of fifth toe)
f1: First toe
f4: Fourth toe
f5: Fifth toe
H1: First eyelet
H2: Second eyelet
IN: Medial side direction
Is: Instep
OUT: Lateral side direction
P1: First opening (of upper)
P2: Second opening (of upper)
Le: Leg
LJ: Lisfranc joint
MP: MP joint
R: Circumference direction
S1: Medial side surface (of foot)
S2: Lateral side surface (of foot)
T: Toe
Y: Front-back direction
Y1: Front side
Y2: Rear side
Z1: Upper side
Z2: Lower side

The invention claimed is:

1. A shoe having a lace fitting structure, comprising:
a sole for absorbing an impact of landing,
an upper for wrapping around an instep, and
a shoelace means for fitting the upper to the instep, wherein:
the upper includes a first opening from which a leg of a wearer of the shoe extends upward when the shoe is worn, and a second opening provided on a front side of the first opening, the first opening and the second opening being continuous with each other in a front-back direction, the upper comprises: a main portion covering a medial side surface, a lateral side surface, a toe, the instep, and a back surface of a foot of the wearer; a side edge portion provided along a side edge of the second opening and having a plurality of first eyelets which the shoelace means passes through and engages with; a first side panel covering the medial side surface of the foot and extending in an upward direction or diagonally upward direction along the medial side surface in a space inside the main portion and a second side panel covering the lateral side surface of the foot and extending in the upward direction or the diagonally upward direction along the lateral side surface in the space inside the main portion, wherein each of the first side panel and the second side panel comprises:

a tip portion having at least one second eyelet which is provided at a tip of each of the first side panel and the second side panel and which the shoelace means passes through and engages with, the first side panel being adapted to cover a metatarsal bone of a first toe of the foot without covering a Lisfranc joint of the first toe or a metatarsal phalangeal joint of the first toe, the second side panel being adapted to cover a metatarsal bone of a fourth toe of the foot without covering a Lisfranc joint of the fourth toe or a metatarsal phalangeal joint of the fourth toe;

a bottom portion attached to at least one of the main portion and the sole; and a middle portion located between the tip portion and the bottom portion so as to allow the tip portion to move in the front-back direction of the foot with respect to the bottom portion, the middle portion being easier to stretch and shrink than the main portion, and the middle portion stretching and shrinking to increase a length from the tip portion to the bottom portion of at least one of the first side panel and the second side panel, wherein:

the at least one second eyelet is a single second eyelet; and two or more of the plurality of first eyelets are posterior to the single second eyelet, and another two or more of the plurality of first eyelets are anterior to the single second eyelet.

2. A shoe according to claim 1, wherein the first side panel is adapted to cover the first metatarsal bone in a medial side without covering a Lisfranc joint of the foot.

* * * * *